United States Patent [19]

De Jule

[11] 4,130,777

[45] Dec. 19, 1978

[54] SCANNING MEANS AND METHOD FOR A PLASMA-SAC-TYPE GAS-DISCHARGE IMAGE DISPLAY PANEL

[75] Inventor: Michael C. De Jule, Chicago, Ill.

[73] Assignee: Zenith Radio Corporation, Glenview, Ill.

[21] Appl. No.: 828,792

[22] Filed: Aug. 29, 1977

Related U.S. Application Data

[63] Continuation-in-part of Ser. No. 769,127, Feb. 16, 1977.

[51] Int. Cl.[2] ..... H05B 37/00; H05B 39/00; H05B 41/00

[52] U.S. Cl. ..... 315/169 TV; 313/193; 313/204

[58] Field of Search ..... 315/169 TV; 340/324 M; 313/191, 192, 193, 204

[56] References Cited

U.S. PATENT DOCUMENTS

| | | | |
|---|---|---|---|
| 3,749,969 | 7/1973 | Miyashiro et al. | 315/169 TV |
| 3,845,241 | 10/1974 | Schwartz | 315/169 TV X |
| 3,999,094 | 12/1976 | Chodil | 313/192 |

OTHER PUBLICATIONS

A Picture-Display Panel Using a Constricted-Glow Discharge, IEEE Transactions on Electron Devices, vol. ED-21, No. 6, Jun. 1974, by Hori, et al.

*Primary Examiner*—Alfred E. Smith

*Assistant Examiner*—Robert E. Wise

*Attorney, Agent, or Firm*—Ralph E. Clarke, Jr.

[57] ABSTRACT

This disclosure sets forth means and method for scanning a high voltage cathodoluminescent television, alpha-numeric or other image display panel having a row and column array of individually controllable plasma-sac-type gas-discharge display elements. The panel envelope contains an ionizable gas at very low pressure, and includes a transparent faceplate on the inner surface of which are disposed cathodoluminescent target elements associated with the display elements. A plasma-sac-generating means includes cathode means and anode means for forming a gas discharge plasma or plasmas, and means for constricting the plasma or plasmas to simultaneously form one or more electron-beam-generating plasma sacs. Control means are provided for controlling the plasma-sac-generating means such that at a given time a plurality of electron beams are generated, each associated with a predetermined display element and target element. Included are means for accelerating the beams from the plasma sac or sacs into high-energy impingement on respectively associated target elements. Scanning means provide for scanning a row of the display elements by activating in sequence and group-by-group consecutive groups of display elements in the row until the entire row of display elements is scanned. Column-scanning is repeated for each selected row until the entire panel has been scanned.

21 Claims, 16 Drawing Figures

SCANNING ANODE DRIVER No. 1
SCANNING ANODE DRIVER No. 2
A1
A2
A3
A4
A5
A6
A7
A8
ø1
ø2
ø14
P=14
n=4
p=12
188
189
192
193
194
104
105(1)
105(2)
105(3)
105(4)
105(5)
105(6)
105(7)
105(8)
106
107
108(1)
109
110A
112R
112G
112B
ROW 1
A57, A113, ETC
A58, A114, ETC
(ETC.)
TO ALL R1s
TO ALL R2s
TO ALL G1s
TO ALL G2s
TO ALL B1s
TO ALL B2s
RED VIDEO GRIDS DRIVER 183
GREEN VIDEO GRIDS DRIVER
BLUE VIDEO GRIDS DRIVER

N=1
N=2···
t=1
t=2
t=3
t=4
t=5
t=6···
ROW 1
RED VIDEO GRIDS DRIVER
GREEN VIDEO GRIDS DRIVER
BLUE VIDEO GRIDS DRIVER
p=12
n=4
P=3
245
250
252
246
244
248
105
106(1)
107
108(1)
112R
112G
112B

SCANNING MEANS AND METHOD FOR A PLASMA-SAC-TYPE GAS-DISCHARGE IMAGE DISPLAY PANEL

CROSS-REFERENCES TO RELATED PATENT APPLICATIONS

This application is a continuation-in-part of copending application Ser. No. 769,127 filed Feb. 16, 1977 and is related to but in no way dependent upon copending application Ser. No. 588,737 filed June 20, 1975, now U.S. Pat. No. 3,992,644, issued Nov. 16, 1976; of common ownership herewith.

BACKGROUND AND PRIOR ART STATEMENT

This invention relates to image display panels of the plasma sac type. It is particularly directed to a scanning means and method for a highly efficient cathodoluminescent panel useful for image displays of such types as alphanumeric and computer graphics, and is well-suited to television displays. To assist in the understanding of the invention and its background, a glossary is supplied at the close of this section.

Although the field of the gas discharge display panels has been diligently explored, no device has yet been able to meet the high standards of performance and the low manufacturing costs established by the cathode ray television picture tube in its current state of development.

Ideally, the gas discharge display panel offers many benefits. First of all, it is not size-limited as stringently as the picture tube, wherein any increase in picture area much greater than the twenty-five inch diagonal measure results in an inordinate increase in bulk an weight. To cite other advantages, flat panel displays, which are commonly built in a matrix of linear rows of columns of discrete picture elements, are inherently capable of producing pictures of near-perfect raster linearity, interlace and color field registration. But these theoretical benefits have been largely offset by undesirable performance characteristics such as inadequate brightness, low luminous efficiency, luminance non-uniformity, and lack of contrast.

Of these problems, inadequate brightness and low luminous efficiency have proved to be among the most troublesome impediments to commercial viability. The maximum level of brightness produced by a discrete picture element in prior art gas discharge panels has been but a fraction of the brightness level of an equivalent picture element in a television picture tube.

The problems cited in the foregoing have contributed in turn to problems in scanning. The simplest means for scanning a display panel, and one which is most compatible with the NTSC system, is to scan each display element sequentially and mutually exclusively until all have been activated. This mode of scanning is known as "point-at-a-time." At television scan rates, each picture element in a display scanned point-at-a-time is activated for a period of one hundred and twenty-five nanoseconds. However, point-at-a-time operation has not been shown to be feasible for prior art display panels wherein individual display elements must be addressed and activated through some form of matrix network. Common problems have included the inability to turn individual display elements on and off quickly enough for point-at-a-time scanning. In panels in which some form of point-at-a-time operation has been achieved, the over-all display has proved to be not nearly bright enough to be competitive with the television picture tube.

In an attempt to adapt prior art display panels for the acceptance of signals at television scan rates, a scanning mode other than point-at-a-time has been used. This mode is "line-at-a-time" operation wherein the incoming information is stored in sample and hold circuits, one for each column of display. This information is transferred to column drivers to activate an entire line of display elements at one time. Two memory stores are required, one to store the incoming information and a second driving memory for displaying the information transferred to it from the storage memory. The advantages of line-at-a-time operation include an increase of about five hundred in duty factor to provide greater brightness, and a decrease in rise and fall times ("turn on" and "turn off" times). The latter advantage is particularly important in a conventional gas discharge device wherein several microseconds may be required to "fire" a gas discharge element. The major disadvantage of the line-at-a-time mode is the requirement for two signal sample-and-hold circuits of a complex and costly nature for each column of the display.

Schwartz, in U.S. Pat. No. 3,904,923, discloses the application of a line of video information in parallel to a full row or a portion of a full row of cathodoluminescent devices (col. 8, lines 24–29). The source of electrons in this device is an electron multiplier.

In view of the foregoing, to achieve a display panel level of performance comparable to the television picture tube, a display panel must provide, primarily, adequate brightness and very fast rise and fall times. A display panel meeting these requirements in described and claimed in the referent application Ser. No. 769,127, of which this present application is a continuation-in-part. It should be clearly understood that the scanning method and apparatus described and claimed in the present application is in no way restricted to the cathodoluminescent panel described and claimed in Ser. No. 769,127, but is applicable to other types of panels having similar physical and operating characteristics; specifically, cathodoluminescent plasma-sac-type gas-discharge image display panels.

Operation of the gas-discharge display panel is based upon the principles of the widely known glow-discharge tube, an example of which is shown by FIG. 1. Enclosed within an evacuated envelope 12 is cathode 14 and anode 16. Envelope 12 may contain one of the noble gases such as krypton or argon, or a common gas such as nitrogen, hydrogen, mercury vapor, or a mixture thereof. A suitable potential applied between cathode 14 and anode 16 results in a glow discharge within the envelope. The entity exhibits classic gas discharge phenomena including a cathode dark space 20, a negative glow 22, a Faraday dark space 24, and a positive column 26.

FIG. 2 shows an element of a prior art gas discharge display panel for producing spots of light utilizing the medium of the gas-discharge tube. In essence, an intermediate apertured insulator 30 is located in a positive column 32 of a gas discharge cell 33. A "plasma sac" 34 (also called an "electrostatic double layer" in the art) forms on the cathode side of the aperture 31. Primary electrons from the cathode 35 generate secondary electrons in the gas discharge which are gathered by the plasma sac 34 and channeled into aperture 31. Light visible to the viewer, indicated by 36, is produced within sac 34 due to the higher electron temperature within the sac as compared to outside the sac. A gas such as neon is used at a nominal pressure of five torr. The phenomenon is described in a journal article entitled "A Picture-Display Panel Using a Constricted Glow Discharge", by H. Hori et al, IEEE transactions on Electron Devices, Vol. ED-21, No. 6, June 1974.

Displays in which a light-emissive material is directly excited by electron bombardment are known as cathodoluminescent displays. Obtaining an adequate number of electrons for adequate excitation of the light-emissive material, and hence adequate brightness, has been a problem in panel displays utilizing cathodoluminescence, as the standard planar gas-discharge cathode in its present state of development does not yield enough electrons at low gas pressures for an effective display. To remedy this deficiency, a structure known as a "hollow cathode" has been introduced into cathodoluminescent panel displays. The copious electrons produced by the hollow cathode is a factor of importance to the effective implementation of the scanning method according to this invention. The use of a hollow cathode in gas discharge displays is disclosed and claimed in referent copending application Ser. No. 588,737, and described and claimed in U.S. Pat. Nos. 3,938,135 and 3,999,094 assigned to the assignee of the present invention. U.S. Pat. No. 3,875,442 to Wasa et al also discloses the use of a hollow cathode in a display panel.

Further with regard to prior art means and methods for scanning gas discharge image display panels, the scanning art can be divided for convenience into three modes: (1) non-bussed scanning, (2) bussed cathode scanning, and (3) plasma sac scanning by bussed anodes.

Non-bussed scanning generally comprises the addressing of an array of conventional discrete gas discharge cells arranged in a "cross-bar" of rows and columns. A two-dimensional matrix arrangement of conductors provides for activating selected cells individually at the conductor intersections by coincident switching. The scanning and modulation technique is described by T. de Boer in a 1968 article entitled "An Experimental 4,000 Picture-Element Gas Discharge TV Display Panel," Proc. Ninth Nat. Symp. on Information Display, pp. 193–200. Also, external cross-bar addressing methods are the subject of an article entitled "Address Methods for Dc Gas Discharge Display Panels," by R. Jackson and K. Johnson, IEEE Trans. on Electron Devices., Vol. ED-18, No. 5, May 1971, pp. 316–322.

Non-bussed scanning schemes have shown salient disadvantages including the requirement for a great number of driving components, one of which is required for each conductor in the matrix. The result is that in panels of this type having television picture display capability, the external addressing means are very numerous, costly and complex and have a high energy demand. In addition, gas panels so addressed have shown inadequate brightness, low luminous efficiency, and a luminous non-uniformity due to non-uniformity of circuit drivers. The great number of electrical leads which must be introduced into the evacuated envelope has also been a problem.

The second mode of scanning in the prior art, bussed cathode scanning, utilizes conventional glow-discharge display panels as in the non-bussed displays with the following important exception: scanning is based upon the phenomenon of primed glow transfer.

"Priming" is a gas-discharge phenomenon wherein the proximity of a discharge will reduce the breakdown voltage of an adjacent, unfired gas discharge cell, or element electrode. The priming effect will cause the discharge to readily transfer to the adjacent electrode associated with said cell, or element. Advantage is taken of the priming effect by bussing every third electrode, for example, in a large array of electrodes. In this way only three drivers (a "three-phase" arrangement) are needed to transfer the discharge and scan the entire array.

In a three-phase arrangement, every third electrode is interconnected and supplied with electrical pulses in the proper phase from an external clock phase generator. For example, the first electrode is connected (bussed) to the fourth, seventh, tenth, etc., electrodes; the second electrode is connected (bussed) to the fifth, eighth, eleventh, etc. electrodes; and so on. In scanning a line, the first three electrodes are first scanned across the array; when the fourth electrode is pulsed to continue the scan, the first electrode is also pulsed because they are interconnected. To insure that the fourth electrode (but not the first) will turn on, it is necessary that enough time has elapsed for the gas in the vicinity of the first electrode to be sufficiently deionized so that it will not break down. The non-proximity of the two electrodes will insure that the discharge is properly transferred to the fourth electrode and not back to the first electrode because the discharge from the third electrode is closer to the fourth electrode than to the first electrode. This close proximity of the third electrode's discharge to the fourth electrode will reduce the fourth electrode's breakdown voltage to a value less than the breakdown voltage of the first electrode and the discharge is transferred to the fourth electrode. The same phenomenon occurs for the seventh, tenth, etc. electrodes as they are pulsed together by one phase of a three-phase driver, for example. In this way the entire array can be scanned with only three drivers in a three-phase arrangement to provide bussed-scanning.

In practice, more than three phases are commonly used to scan a panel because of the limits imposed by the gas-panel deionization time. As mentioned, sufficient time must elapse between the time when bussed electrodes are pulsed again so that the gas can deionize and return to its initial (unprimed) high breakdown voltage. The deionization time of gas discharges is typically greater than several microseconds. However, to scan point-by-point for a TV picture at NTSC standards requires that each scanning phase be of a duration of approximately 125 nanoseconds. As a result, a great many phases must be used in point-by-point scanning. For example, a deionization time of 5 microseconds requires forty phases (5 microseconds/0.125 microseconds) for bussed-scanning. A bussed-cathode system is described by the Burroughs Corporation in Bulletin 1161, *Self-Scan TM Panel Display,* and Bulletin S101C, *Application Notes;* also, the bussed-cathode system is described in an article titled "Dot Matrix Display Features Inherent Scanning Ability," by William J. Harmon, Jr., *Electronics,* Vol. 43, Mar. 2, 1970, pp. 120–125.

Ogle, in U.S. Pat. No. 3,742,483, describes a system for video display that utilizes small dot-like, gas-filled cells; a typical panel cited by Ogle is the Self-Scan TM display described in the foregoing. The Ogle system includes, in one embodiment, means for applying both a video signal and a control signal to the driver circuit to thereby control the amplitude and time duration of the current flowing through a cell, thus controlling the cell brightness. Also, the following journal article describes a method for displaying TV pictures using bussed cathode scanning: "Good Quality TV Pictures Using a Gas-Discharge Panel," by G. Chodil, M. DeJule and J. Markin., IEEE Trans. on Electron Devices, Vol. ED-20, No. 11, November, 1973, pp. 1098–1102.

These examples of bussed scanning are all concerned with bussing the cathode electrodes and hence are examples of "bussed-cathode" scanning. As noted, such bussed-cathode scanning is made possible due to the phenomenon of a negative glow discharge which localizes itself on the cathode electrode, and with proximity priming provided by the negative glow discharge. An analogous situation arises at the anode wherein a plasma sac discharge can provide a localized priming effect. The latter is the third mode of scanning, termed "plasma sac scanning by bussed anodes."

Plasma sac scanning by bussed anodes is described in the aforementioned journal article by Hori et al, wherein an intermediate electrode 38 (referring again to FIG. 2) plated inside aperture 31 is used for propagation of the plasma sac 34 to an adjacent aperture having a similar intermediate electrode (not shown). Propagation is due to a priming effect in a fraction of the brightness of a television cathode ray picture tube.

A gas discharge display apparatus utilizing a scannable plasma sac is disclosed by Miyashiro et al in U.S. Pat. No. 3,749,969. This patent disclosed means for the two-dimensional scanning by rows of individual cells in a display panel array. To scan a row, a sac is initiated at the start of the row, and is caused to move progressively from cell to cell by changes in the potential on a control electrode associated with each of said cells. The cell control electrodes can be electrically linked in a phase arrangement to limit the number of leads required and provide bussed scanning.

To prevent confusion of nomenclature, note that *Self-Scan TM* is the Burroughs Corporation designation for their bussed-cathode panels, whereas "bussed-scanning" is a general term that refers to "bussed-cathode scanning" of cathodes, anodes or other electrodes which are interconnected at regular intervals.

OTHER RELATED PRIOR ART

Non-Bussed Scanning

An article "Principles and Techniques in Multi-Color DC Gas Discharge Displays," by Z. Van Gelder and M. Mattheij., Proc. of the IEEE, Vol. 61, No. 7, July, 1973, pp. 1019–1024; also, U.S. Pat. Nos. 3,662,214; 3,749,972; 3,800,186; 3,801,864; 3,845,241; 3,875,442; 3,956,667; 3,979,718; and, 1,433,256 (Great Britain).

Bussed-Cathode Scanning

U.S. Pat. Nos. 3,701,924; 3,766,420; 3,875,474; 3,809,952; 3,882,342; 3,938,135; 3,989,981; and 3,995,185.

Plasma Sac Scanning by Bussed Anodes

An article "A New Gas-Discharge Display Device Using Through-Hole Enhancement," Hori et al, IEEE Trans. on Electron Devices, Vol. ED-21, No. 6, June, 1974; an article in Japanese entitled "Plasma Display Panel of an Electron Accelerated Type," Okamoto et al. ED75-58. 1975; also, U.S. Pat. No. 3,749,969.

Examples of the plasma sac used to prime a cathode are given in the following two journal article preprints. (The "intermediate" electrode described in the preprints performs a dual function by acting as a constricting aperture to form the plasma sac, and, as a cathode for the display cell.) Preprint No. 463, "Electron Accelerating Plasma Display Cell," Mizushima et al; and, Preprint No. 18-2, "Electron Accelerating Plasma Display Cell: Fundamental Characteristics of Line-at-a-Time Addressing Mode," Okamoto et al.

General Background

Priming and self-scanning, deionization and recovery time are topics of a book entitled *Cold Cathode Glow Discharge Tubes*, by G. F. Weston. ILIFFE Books, Ltd. 1968, pp. 63–65, 281–287.

GLOSSARY

Bussed Scanning

Scanning by interconnecting electrodes in "phases"; e.g., every Nth electrode is interconnected and activated in the proper phase by pulses from an external clock generator. N phase pulses scan the discharge across C electrodes when C is greater than N.

Bussed Cathode Scanning (See also Bussed Scanning, and Self-Scan TM.) Bussed scanning by interconnecting cathode electrodes in "phases," based upon the phenomenon wherein a negative glow discharge can provide localized priming effects.

Cathodoluminescent Display

A display in which a light-emissive material is directly excited by electron bombardment.

Deionization Time

That period of time required for a gas to revert to its non-ionized state in a gas-discharge cell upon removal of the applied potential.

Display Element

Those structures and partial structures in a display panel which cooperate to produce a single point of light in the panel. In a monochrome panel, each display element is picture element. In a color display panel, each picture element is comprised of a triad of display elements.

Group

Also termed "display group." In the context of this disclosure, and according to this invention, a "group" comprises at least two discrete display elements associated with plasma sacs which are simultaneously activated and electrically bussed to non-neighboring, regularly recurring, like-numbered other groups of display elements similarly constituted, and activated in sequence by consecutive groups; and (defined in relation to phase time T) . . .A display group is a collection of elements that contribute to activating a discrete, predetermined number of display elements during one phase time T.

Group-by-Group Scanning

According to the present invention, scanning of the image display is accomplished by activating groups of display elements, group-by-group. (See definition of "group.")

Line-at-a-Time Scanning

Scanning whereby the incoming information is stored in sample-and-hold circuits, one for each column of display. This information is transferred to column drivers to activate an entire line of display elements at a time.

Mathematical t — is the number of display groups in one row of the display
P — is the number of phases
N — is the number of phase groups per row
$t_g$ — is the gap between phases; or "de-energized time"
C — is the number of display element per row
$t_i$ — is the deionization time of the gas
T — is the time duration of excitation of one phase group
P — is the number of display elements per display group
n — is the number of scanning anodes per display group
m — is the number of display elements per scanning anode Non-bussed Scanning Generally comprises the addressing of an array of electrodes arranged in a cross-bar of rows and columns.

Phase (As in "phased scanning," or "scanning by phases." See definition under "Bussed Scanning," and definition of "Phase Time.").

Phase Group

That collection of display elements activated during one complete cycle of phases (one rotation of the rotary switch analog).

Phase Time

Phase Time ("T") is the duration of excitation of one phase ("energized time"); this is the time of excitation of a group of display elements (See 194 of FIG. 12.)

Picture Element

One increment of display information comprising, in a monochrome panel, a monochrome phosphor element; and in a color panel, a color triad element.

Plasma Sac

Also called an "electrostatic double layer" in the art, the plasma sac forms on the cathode side of a barrier between the cathode and anode of a glow discharge, the barrier having a constrictive aperture therein. The plasma sac forms about the aperture and gathers secondary electrons in the gas discharge and channels them into the aperture.

Plasma Sac Scanning by Bussed Anodes

Bussed scanning by interconnection anode electrodes in "phases," and based upon the phenomenon wherein a plasma sac discharge can provide a localized priming effect, as distinguished from negative glow priming effect in bussed cathode scanning.

Point-at-a-Time Scanning

Scanning each picture element of a display panel sequentially and mutually exclusively until all have been activated, after which the sequence is repeated. The television picture tube used in consumer electronics is commonly scanned point-at-a-time.

Priming

A gas-discharge phenomenon wherein the proximity of a discharge reduces the breakdown voltage of an adjacent, unfired gas discharge cell or element electrode.

Self-Scan TM

The Burroughs Corporation designation for bussed-cathode panels manufactured under the *Self-Scan* trademark.

Target Element

An increment of phosphor deposited on the inner surface of the display panel and activated by a concentrated electron beam. In a monochrome display panel, a target element comprises a white-light-emitting phosphor; in a color display panel, the target elements comprise three different discrete phosphors capable of emitting red, green and blue light.

Triad

A set of three target elements comprising red, green and blue light-emissive phosphor deposits.

OBJECTS OF THE INVENTION

It is a general object of this invention to provide improved means and method for scanning plasma sac type gas discharge image display panels.

It is a more specific object of this invention to provide a scanning method and apparatus for plasma-sac-type gas-discharge panel display that requires fewer inputs for modulation, picture element selection, scan control and signal storage, and thus requires the entry of fewer operating leads and scanning control leads into the evacuated envelope.

It is yet another specific object to provide a display panel scanning method and apparatus that reduces display element duty factor and display element response time requirements.

BRIEF DESCRIPTION OF THE DRAWINGS

The features of the invention which are believed to be novel are set forth with particularity in the appended claims. The invention, together with further objects and advantages thereof may best be understood, however, by reference to the following description taken in conjunction with the accompanying drawings in which:

DESCRIPTION OF THE PREFERRED EMBODIMENT

Figure 1:
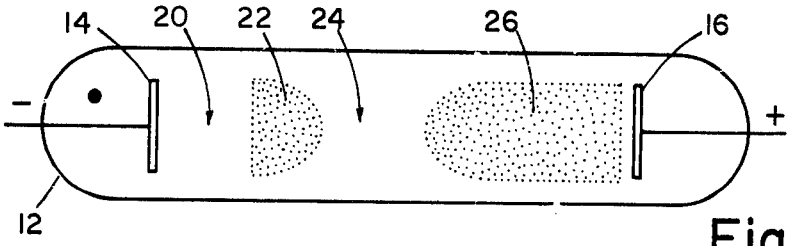
Fig. 1 PRIOR ART
FIG. 1 is a schematic view of a glow discharge tube of a type widely known in the art.
Figure 2:
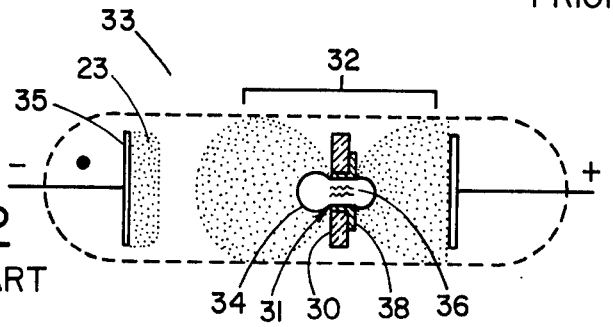
Fig. 2 PRIOR ART
FIG. 2 illustrates in schematic form an element of a prior art gas discharge display panel wherein the visible light is an emanation of a plasma sac.
Figure 3:
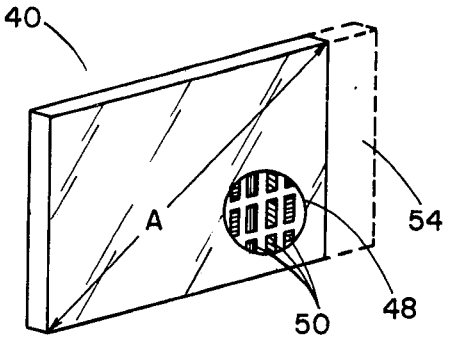
FIG. 3 is a highly simplified representation of a display panel constructed according to the teachings of referent copending application Ser. No. 762,127 (of which the present application is a continuation-in-part), and which is scanned by the means and method according to the present invention.

With reference to FIG. 3, there is shown figuratively a very-low-pressure, high-voltage cathodoluminescent display utilizing the scanning means and method according to this invention. To add clarity to the description that follows, certain illustrative dimensions and values are given in the course of the specification, but in no manner are they to be considered limiting.

Section 48 of FIG. 3 represents a very small area of the faceplate 42 greatly enlarged to show an ordered array of red-light-emitting, green-light-emitting and blue-light-emitting cathodoluminescent target elements 50. The ancillary electronic circuits, which in the case of the television display would include circuits for video processing and scanning, are shown schematically as being contained in electronic section 54.

Figure 4:
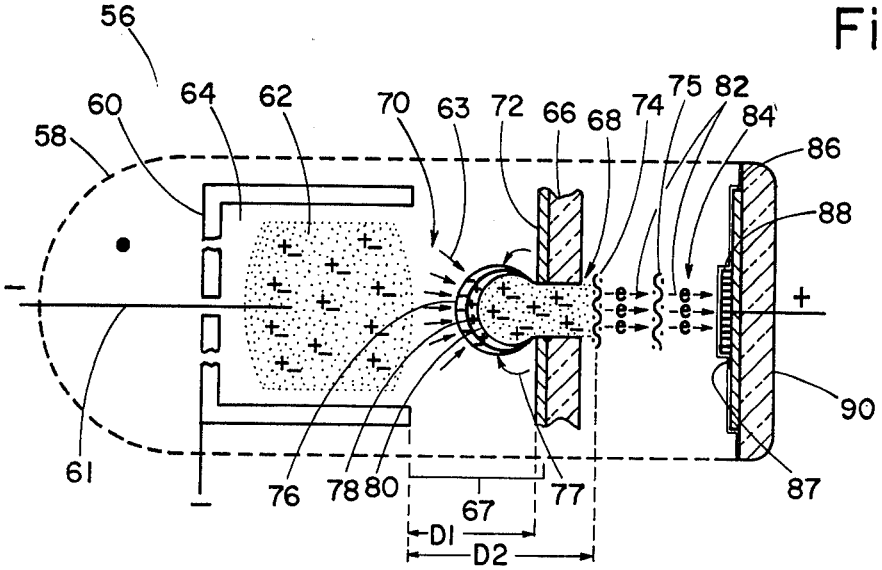
FIG. 4 is a simplified schematic illustration of a single gas-discharge display element representing a preferred mode of execution of the invention according to the Ser. No. 762,127 disclosure.

FIG. 4 illustrates a single gas discharge plasma sac type display element 56. As used, herein, the term "display element" is intended to mean those structures and partial structures which cooperate to produce a single point of light in the panel. In a monochrome panel, each display element is a picture element. In a color display panel, each picture element is comprised of a triad of display elements.

Display element 56 as shown and described is to be considered as a microcosm of each of the hundreds of thousands of identical elements which, for example, may be incorporated into the figurative television display panel 40 shown by FIG. 3, and which are scanned according to this invention. Display element 56 as shown provides a single point of light and hence comprises a part of a monochrome panel.

Display element 56 is shown as being enclosed in an evacuated envelope containing an ionizable gas at a predetermined very low pressure. Envelope 58, indicated by a broken line in FIG. 4, symbolically represents the panel-form envelope 40 shown by FIG. 3. The components comprise a rearwardly disposed hollow cathode 60 for receiving a relatively low applied voltage. Electron-transmissive anode 74 (also referred to as a "scanning anode" as will be described hereafter) is spaced a predetermined distance from cathode 60 and receives a relatively intermediate applied voltage. Constriction-forming means 66 located between cathode 60 and anode 74 forms a narrow opening to define a constriction 68. A performance enhancement electrode 72 is located between cathode 60 and anode 74. Between cathode 60 and performance enhancement electrode 72 lies the Faraday dark space 70. The intermediate applied voltage of anode 74, the predetermined distance between cathode 60 and anode 74, and the very low gas pressure have values effective to support a gas discharge between cathode 60 and anode 74, and to cause a plasma sac 76 to form in the plasma on the cathode side of constriction-forming means 66. The plasma sac 76, by its nature, generates and gathers electrons from cathode 60 and accelerates them into constriction 68 to form a concentrated electron beam therein.

An ultor electrode 86 is disposed contiguous to cathodoluminescent target element 88 on transparent faceplate 90 for receiving a predetermined relatively high ultor voltage. Ultor electrode 86 is separated by predetermined spacing from grid 75 to define an acceleration section 84 therebetween. This predetermined spacing is so small that at the predetermined very low pressure and at the ultor voltage cited, no gas discharge plasma can possibly occur in acceleration section 84. The operating point is to the left of the Paschen curve minimum (more later on this). The ultor voltage establishes a high-voltage gradient in the plasma free acceleration section 84 which is effective to straight-line accelerate the beam of electrons 82 formed in constriction 68 in a substantially collision-free path directly into high-energy bombardment of the cathodoluminescent target element 88 disposed on faceplate 90.

Light-stopping means, here shown as including a continuous, light-reflecting layer 87, blocks from view the light produced by the plasma whereby useful visible light produced by the panel is solely that produced by the high-energy electron bombardment of the cathodoluminescent picture element 88 disposed on faceplate 90. Ultor electrode 86 as shown is light-transmissive. The grid means comprises anode 74 and at least one electron-transmissive modulating grid means 75 located down-beam of anode 74.

Figure 7:
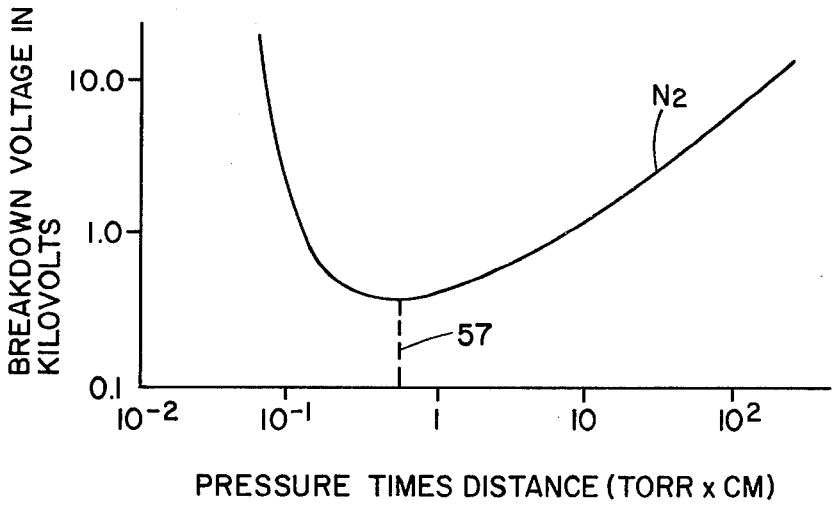
FIG. 7 is a "Paschen" curve illustrating a relationship between pressure, path length, and breakdown voltage in a gas discharge display element.

A detailed functional description of the display element illustrated by FIG. 4 now follows. The ionizable gas enclosed in evacuated envelope 58 may comprise a single gas, or a mixture of gases. Typical gases that may be used in the panel are the noble gases such as krypton and argon, or the more common gases such as hydrogen, nitrogen, mercury vapor or mixtures thereof, such as a Penning mixture. A preferred gas is pure nitrogen; a typical Paschen curve for nitrogen is shown by FIG. 7. The gas pressure is a fraction of a torr for electrode spacings of a few millimeters, and operation is well to the left of the Paschen minimum 57. A useful operating point, for example, occurs at 0.06 torr-centimeters. This corresponds, e.g., to a pressure of 0.2 torr with the electrodes 75 and 86 separated by 0.3 centimeter in the plasma-free acceleration region. The benefits of panel operation at this very low pressure will be described in relation to component operation and scanning in the following description.

The U-shaped configuration of rearwardly disposed hollow cathode 60 creates an efficient collecting cavity that traps metastable atoms, ions and ultraviolet photons on the enclosing walls, liberating as a result copious electrons. Also, electrons are reflected inside the cavity to provide a "circulating" electron current to greatly enhance the probability of ionizing gas atoms. This circulating current permits operation at lower gas pressures than with a planar cathode. The hollow cathode effect is evident at low gas pressure as the negative glow, which normally covers each metal surface in a sheath at high gas pressure, merges into one large negative glow which comprises a plasma in the center of the hollow cathode at low pressure. The effect is shown schematically in FIG. 4 as plasma 62 is surrounded by a cathode dark space 64. The hollow cathode may, e.g. be at a potential of approximately minus 300 volts.

In the FIG. 4 configuration, one hollow cathode 60 is shown as supplying one plasma sac 76 with a flow of electrons 63 within one display element 56. However, a single hollow cathode is not so limited in area, but may span a predetermined number of rows and columns of display elements. Within a large-area hollow cathode configuration, a single plasma sac, or groups of sacs according to this invention may draw electrons from the large area within the hollow cathode.

The use of the hollow cathode provides many benefits. In addition to providing copious electrons, the hollow cathode offers the fast switching characteristics of the planar cathode necessary for rapid scanning, and provides efficient operation at higher current levels. Another benefit lies in the fact that the hollow cathode functions efficiently at very low values of "Pd" (gas pressure times distance) between the anode and the cathode which as mentioned, and with reference to FIG. 7, is for example, 0.06 torr-centimeters in pure nitrogen. This ability of the hollow cathode to function at very low Pd values provides, in turn, a singularly desirable characteristic; that is, the ability to produce at a given time one or more high-density electron beams for high-energy bombardment of cathodoluminescent target elements without forming a gas discharge plasma in the acceleration section. The accelerating section 84 is the region between modulating grid 75 and the accelerating electrode—ultor electrode 86.

The breakdown voltage between the hollow cathode 60 and performance enhancement electrode 72 is of the order of one kilovolt. This relatively high breakdown voltage exceeds the capabilities of standard transistor circuits where it may be desirable to selectively pulse groups of hollow cathodes in a display according to this invention. This voltage can be reduced, however, to a few hundered volts by first priming the hollow cathode with an auxiliary, or priming discharge. A feasible means for producing such a priming discharge is by the use of the ignitor wire 61. As shown by FIG. 4, ignitor wire 61 extends into the approximate center of cathode 60. The ionization of the gas in the vicinity of ignitor wire 61 as electrons orbit the wire and are trapped in the wire's radial field, effectively lowers the breakdown voltage to a few hundred volts. During operation, there is only a small trickle of current through ignitor wire 61, providing a "keep alive" current so that hollow cathode 60 remains in a primed condition wherein its breakdown voltage may be less than 400 volts, for example. Ignitor wire 61 may be energized by a pulse or by a steady flow of current. Other hollow cathode activating means may be used such as, for example, a point electrode located near the side of hollow cathode 60.

This invention is no way limited to the use of the hollow cathode as an electron source. A heated planar cathode, for example, especially designed to be highly efficient, could as well be used in lieu of the hollow cathode. Also, in the interest of energy conservation, it is well within the scope of this invention to utilize other sources of electrons such as provided by field emission. Thermionic cathodes, while increasing power consumption, could as well be used; however, the large thermal time lag would restrict the ability to switch groups of such cathodes on and off where it is desired to cause the plasma sac to move to different locations while scanning a display. Whatever type of cathode is used, it must preferably meet the performance standards set by the hollow cathode as described.

Further with regard to FIG. 4, electron-transmissive anode 74 is located forwardly of cathode 60 and is spaced a predetermined distance from cathode 60 for receiving a relatively intermediate applied voltage. Constriction-forming means 66 is disposed between anode 74 and cathode 60, and defines at least one constriction as will be described infra.

Performance enhancement electrode 72 is shown as being a distance $D_1$ from cathode 60, with anode 74 being at a greater distance $D_2$ from cathode 60. Performance enhancement electrode is located contiguous to and parallel with constriction-forming means 66, which is shown as being an insulator, and receives a voltage intermediate to the relatively intermediate voltage on anode 74 and the relatively low voltage on cathode 60. Constriction-forming means 66 defines at least one constriction 68 registered with a constriction in performance enhancement electrode 72. These registered constrictions are respectively associated with one or more display elements 56, as will be shown. The intermediate voltages cited, the distance $D_2$, the very low gas pressure and the width of the registered constrictions have values effective to support a gas discharge plasma between cathode 60 and anode 74 and to cause a plasma sac 76 to form in the plasma about constriction 68 in performance enhancement electrode 72 on the cathode side of constriction-forming means 66. The plasma sac by its nature generates and gathers electrons from a large area of hollow cathode 60 and accelerates them into registered constrictions 68 to form a concentrated electron beam therein.

The performance enhancement electrode provides several functions. For example, it serves to stabilize plasma sac 76 in registered constriction 68 by conducting electrons from a surrounding area to plasma sac 76, and thus discourages the formation of a sac in non-energized neighboring constrictions. Performance enhancement electrode also serves to prime the contained gas in the region of said constriction, thereby permitting a plasma sac 76 to be established in constriction 68 by application of a lower voltage on anode 74 than otherwise possible, and is believed to supply electrons to sac 76, as shown by arrows 77. The performance enhancement electrode thus appears to act as both an anode and a cathode—an anode which assists in establishing a gas discharge between cathode 60 and anode 74, and a cathode by supplying electrons to plasma sac 76.

As noted, ignitor wire 61 initiates a gas discharge inside the hollow cathode. The performance enhancement electrode 72, functioning as an anode, initiates the discharge outside the hollow cathode 60 in order to prime the plasma sac. Thereafter, a plasma sac forms on the cathode side of constriction 68 when a positive potential of, for example, 150 volts is applied to anode 74. A plasma sac forms when the current demand through constriction 68 exceeds the current that can normally be conducted by the low-temperature plasma near constriction 68. As the voltage is raised on anode 74, a threshold current and voltage is reached wherein plasma sac 76 suddenly forms. The threshold voltage will vary depending on gas pressure, gas constitution, the size of constriction 68, and cell-wall geometry. Due to this threshold phenomenon, more than one display element and associated plasma sacs can be energized group-by-group according to this invention, as will be shown.

Primary electrons from cathode 60 ionize gas atoms and produce secondary electrons. These secondary electrons produce a plasma or "sea" of electrons that then act as the source of electrons for the plasma sac.

Figure 5:
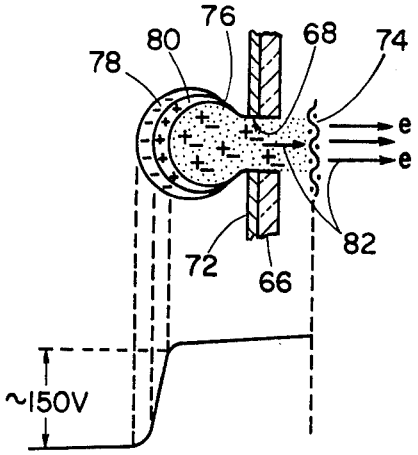
FIG. 5 shows in greater detail the form and the distribution of potentials of the plasma sac shown by FIG. 4.

Plasma sac 76, by its nature, gathers electrons emitted by hollow cathode 60 and accelerates them into constriction 68 to form a concentrated electron beam 82. Referring additionally to FIG. 5, plasma sac 76 is comprised of an outer sheath 78 which comprises a negative space charge layer, and an inner sheath 80 which comprises a positive space charge layer. A potential of about 150 volts (in this example) exists between these two layers as shown by the associated relative-voltage-versus-distance curve of FIG. 5. Electrons are collected and accelerated from the outer sheath 78 into the sac by the 150-volt increase in potential. The 150-volt increase between the two sheaths 78 and 80 provides an impedance-matching function necessary to increase the conductivity of the plasma within constriction 68, and thus allows a higher current to pass through the constriction. The conductivity of the plasma in the area outside the sac is lower than the conductivity of the plasma in the area inside the sac. Low conductivity corresponds to low plasma electron temperature while high conductivity corresponds to high plasma electron temperature, in this case. After electrons are accelerated from the outer sheath 78 into the sac, they may produce additional ionization within the sac itself. This also contributes to the higher current passing within constriction 68.

In addition to being able to gather electrons from cathode 60 and accelerate them into a constriction to form a concentrated electron beam, plasma sac 76 offers another benefit in its ability to move or "scan" either singly or in groups from one constriction to the nearest energized neighboring constriction (not shown) very rapidly; e.g., in a period of less than 200 nanoseconds.

An electron "drift space" can be of value in moderating the relatively high energy of several hundred volts of the electrons emitted by hollow cathode 60. Electron energy can be lowered an order of magnitude to tens of volts by means of the drift space 67. Drift space 67 of FIG. 4 represents the distance between hollow cathode 60 and constriction-forming means 66, which may, e.g., be about 0.75 inch. The drift space comprises the Faraday dark space in the embodiment shown. The provision of a drift space in display panels is described and claimed in U.S. Pat. No. 3,999,094 to Chodil, assigned to the assignee of this invention.

The concentrated electron beam 82 emerging from constriction 68 passes through electron-transmissive anode 74 and electron-transmissive modulating grid 75, which is disposed between anode 74 and ultor anode 86. The beam is modulated by grid 75 which has thereon a time-varying signal which may range from zero volts through one hundred and fifty volts, for example. The time-varying signal may represent television picture information according to this invention.

The concentrated electron beam 82 now enters acceleration section 84. The ultor voltage of ultor electrode 86 is a voltage in the range of many hundred to tens of thousands of volts, establishing a high-voltage gradient in the plasma-free acceleration section 84. This relatively high voltage is, in any case, a voltage greater than any one of the discrete voltages or voltage differences existing in the plasma of display element 56, such as the anode fall, cathode fall, positive column, negative glow column, or the voltage differential in the plasma sac. The ultor voltage is effective to straight-line accelerate the beam 82 of electrons (indicated by the symbol e) in a substantially collision-free path directly into high energy bombardment of cathodoluminescent target element 88 disposed on transparent faceplate 90.

Light-stopping means is provided for blocking from view light produced by the plasma, whereby the useful visible light produced by the panel is solely that produced by the high-energy electron bombardment of cathodoluminescent target element 88. The light-stopping means is here shown as including a light-reflective, electrically conductive film 87 (an aluminum layer, e.g.) disposed on cathodoluminescent target element 88. The film 87 may also comprise the ultor electrode.

Anode 74, in cooperation with modulating grid 75 located down-beam of anode 74, provides for modulating the concentrated electron beam with a time-varying voltage to provide in cooperation with anode 74 full intensity control of the beam wherein a range of differences in potentials between anode 74 and modulating grid 75 provides a related range of differences in electron current, and thus a related range of differences in luminous output from cathodoluminescent target element 88. Tests have shown that a gray scale of 1000:1 or more is possible.

When the potential on anode 74 is raised from zero to 150 volts, a plasma sac 76 forms. If the potential on modulating grid 75 is zero, however, there will be no current flow from constriction 68, and display element 56 will effectively be biased to cut-off, and the associated cathodoluminescent target element 88 will not be activated. As the potential on modulating grid 75 is raised, increasing beam current will flow, the level of which is proportional to the voltage level on modulation grid 75 to the point of maximum current flow for maximum luminous output. Thus a full range of grays is provided by the two cooperating grids.

For a display requiring little or no gray scale such as the alphanumeric, display element 56 may comprise only anode 74, without the presence of modulating grid 75. The use of a single electron-transmissive anode 74, provides a monochrome image display relatively devoid of intermediate gray tones. By itself, the single anode cannot fully control beam current flow, so there is an abrupt threshold at which the plasma sac 76 forms, and substantial current is initiated. As a result, when only a single grid is used, a very limited range of grays can be obtained due to the high threshold level; that is, nominally a gray scale ratio of about 10 to 1.

The components that form the plasma sac; i.e., constriction-forming means 66 and associated parts may lie near the positive column. Constriction-forming means 66 and associated plasmasac-forming components could as well be located within the positive column, or, in the negative glow region of the gas discharge.

Figure 6:
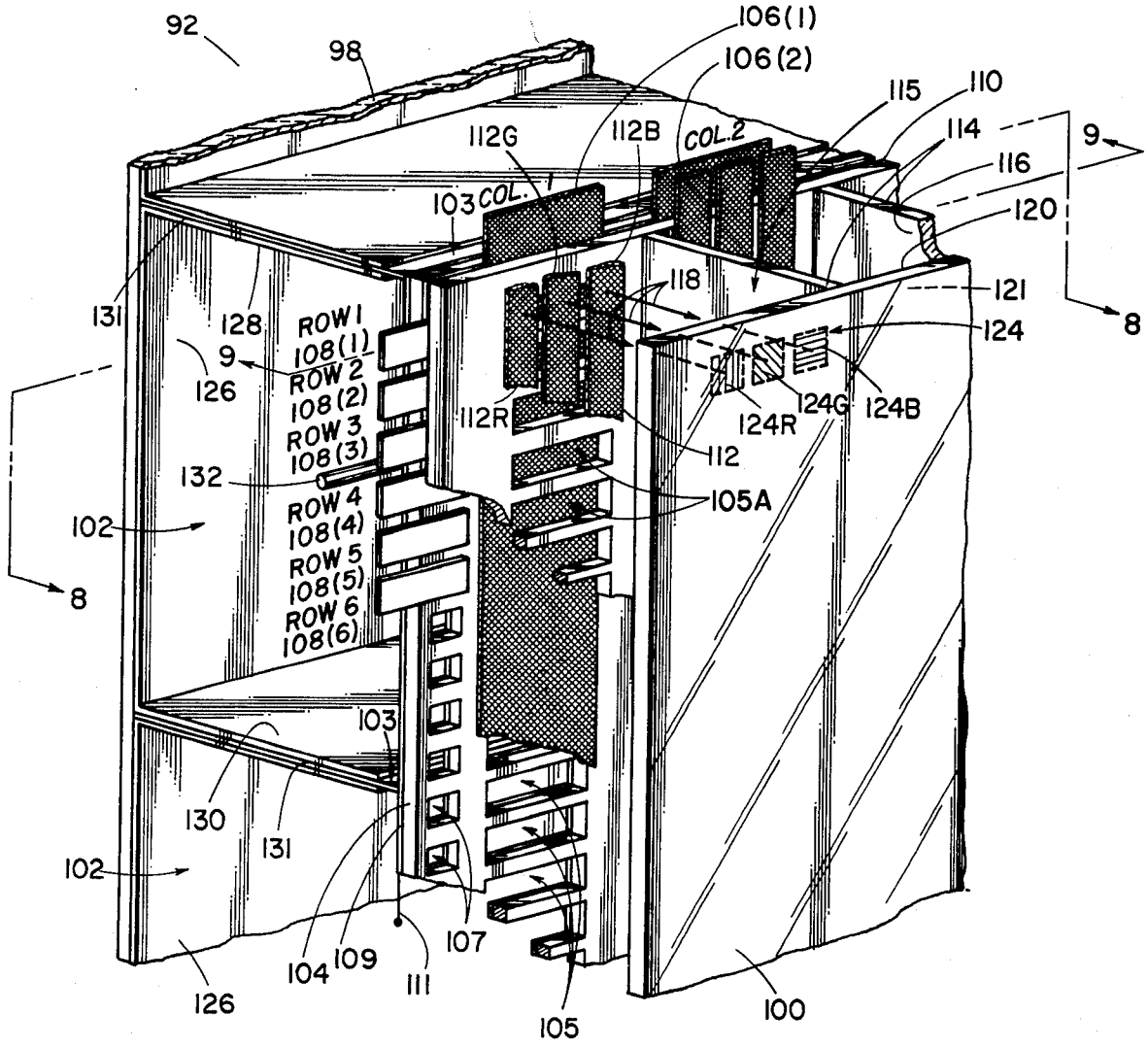
FIG. 6 is a schematic fragmentary perspective view, broken away, of a display panel scanned according to this invention.

Referring now to FIG. 6, a section of a full display panel structure according to this invention is shown, comprising a very-low-pressure, high-voltage gas discharge image display panel 92 having a row-and-column array of individually controllable plasma-sac-type gas-discharge display elements, and including envelope means containing an ionizable gas at a predetermined very low pressure on the inner surface of which are disposed cathodoluminescent target elements associated with each display element.

The panel comprises plasma-sac-generating means including cathode means and anode means for forming a gas discharge plasma or plasmas, and means for constricting the plasma or plasmas to simultaneously form one or more electron-beam-generating plasma sacs. Control means are provided for controlling the plasma-sac-generating means such that at a given time a plurality of electron beams are generated, each associated with a predetermined display element and target element. The control means includes modulating grid means respectively associated one-for-one with the electron beams for modulating the electron beams. Means are also provided for accelerating the electron beams from the plasma sac or sacs into high-energy impingement on respectively associated cathodoluminescent target elements. Scanning means are coupled to the control means and to the plasma sac generating means for scanning a row of the display elements by activating in sequence and group-by-group consecutive groups of display elements in the row until the entire row of display elements is scanned, non-neighboring, regularly recurring like-numbered groups of display elements being electrically bussed such that the scanning is accomplished in a bussed-scanning mode. Scanning and modulating are repeated for each selected row until the entire panel has been scanned, whereby the activating of the display elements in element groups and the bussed-scanning and modulating of the panel of element groups in the horizontal direction, and by individual rows in the vertical direction, the brightness of the panel is enhanced at modest memory circuit requirements and scanning circuitry and panel lead-ins are minimized.

Referring to FIG. 6, column one of the array comprises the left-most column of the display from the viewer's aspect. In TV applications, for example, the array may comprise five hundred columns across the width of the panel, with the columns extending from top to bottom of the display area. There also may be five hundred rows of display elements of the array extending the entire depth of the panel. In addition, there may be about fifty row-wise extending hollow cathodes 102, each providing for ten rows of display elements, as in this example.

The primary components of the display panel are listed as follows from back wall 98 to front of the panel which comprises transparent faceplate 100. Located toward the back of the panel are the electron source means for producing at a given time a plurality of high-density electron beams associated with each of said display elements. The electron source means comprise the following components: Contiguous to back wall 98 is a rearwardly disposed array of large-area hollow cathodes 102, each spanning a predetermined plural number of rows (here ten) and columns (here all), and capable of supplying copious electrons at the aforedescribed predetermined very low gas pressure. Each hollow cathode is electrically discrete and receives a relatively low voltage; for example, minus 300 volts. Hollow cathode 102 is comprised of top plate 128 and bottom plate 130 which are electrically isolated from forwardly located adjacent structures by insulators 103. Each hollow cathode 102 is electrically isolated from adjacent cathodes by insulators 131 located therebetween. An ignitor wire 132 extends row-wise in the center area of each hollow cathode 102 for priming the associated cathode, in this example.

The constriction-forming means comprises a barrier 104 located between anodes 106 and cathodes 102 and defines a predetermined number of narrow openings (constrictions) 105 each associated with a particular anode means 106(1), 106(2) etc., and one or more display elements 124. In the configuration shown, barrier 104 comprises a planar-form insulative means having at least one opening therein for each display cell, and around which is selectively formed a plasma sac. (Plasma sacs are not shown by FIG. 6.) As described in the foregoing in relation to FIG. 4, each plasma sac, by its nature, generates and gathers electrons from a large surrounding area of the associated hollow cathode 102 and accelerates them into the associated opening (constriction) to form a concentrated electron beam therein. In the panel shown, there are preferably about 250,000 narrow openings 105 in barrier 104.

Performance enhancement electrode 109 is shown as being located contiguous to and parallel with barrier 104 and on the cathode side of the barrier and co-extensive without interruption across the width and height of panel 92. Electrode 109 receives through a single input terminal 111 a voltage intermediate to the relatively intermediate voltage on anodes 106 and the relatively low voltage on hollow cathodes 102. Performance enhancement electrode may have an opening in alignment with each of the openings 105 in barrier 104, with both openings in registration. About each of said registered openings, and on the cathode side of barrier 104, a plasma sac will form as described in the foregoing.

Located forwardly of cathode 102 and performance enhancement electrode 109 are column-wise oriented electron-transmissive anodes 106 arranged in columns. Anodes 106, described as providing an anode function only, also may have a scanning function as will be shown. In view of this dual function of performing as an anode, and, as a scanning electrode, anodes 106 are hereinafter termed "scanning anodes." Scanning anodes 106 are numbered 106(1), 106(2), etc., to indicate the row-wise succession of these columnar grids across the display panel. There may be 500 row-select grids 108 associated with the desired row to provide enabling voltages in each row for row selection of the 500 rows of the display elements. Also, there may be 500 column-wise extending scanning anodes 106; applying a pulsed voltage on the scanning anodes of groups of consecutively arranged display elements provides for the selective activation of columns of these display elements by group.

Each scanning anode 106 covers a column of openings 105 in barrier 104, also as shown. Scanning anodes 106 are spaced a predetermined distance from cathode 102, are electrically discrete and receive a relatively intermediate applied voltage. The combination of cathode 102, scanning anodes 106, and barrier 104, together with said intermediate voltage, the predetermined distance between cathode 102 and anode 106, and the very low gas pressure have values effective to support a gas discharge plasma between cathode 102 and scanning anodes 106 to cause a plasma sac to form in the plasma on the cathode side of the constriction-forming means (barrier 104) around each constriction associated with a selectively energized scanning anode 106.

A single column of row-select electrodes numbered 108(1), 108(2) etc., lie in the same plane as scanning anodes 106 and provide for the selection of the row to be scanned in the panel. Barrier 104 defines a plurality of narrow openings, or constrictions, 107 associated with row-select electrodes 108. It will be noted that each row-select electrode extends row-wise only far enough to cover one opening 107 in barrier 104. A plasma sac for initiating row-wise scanning is started at the beginning of any row by the activating of an associated row-select electrode 108.

Spacer 110 may be a planar-form insulator having a plurality of openings 105A in registration with openings 105 of barrier 104. It will be noted that there are no openings in spacer 110 in registration with openings 107 in the colum of row-select electrodes 108 as this column is not a light-emissive display element. Row-select electrodes 108 also comprise solid metal plates to further block any light that might be emitted as a result of the row-selection operation.

Adjacent to spacer 110 are located a plurality of electron-transmissive modulating grids 112, located down-beam of the scanning anodes and arranged in columns extending vertically the full height of the panel and substantially parallel to anodes 106. The configuration of modulating grids 112 shown by FIG. 6 comprises a trio of grids numbered 112R, 112G, 112B for modulation of triads of cathodoluminescent target elements respectively associated with red, green and blue picture information of a color television display panel. The high-density electron beam which is co-extensive with the predetermined group of cathodoluminescent target elements 124R, 124G, and 124B is similarly divided into a plurality of beamlets 118, one for each target element in said group. The modulating grids provide for modulating the electron beam or beams with a like plurality of time-varying voltages to provide in cooperation with the associated scanning anodes full intensity control of the electron beam or beams, wherein a range of differences in potential between the scanning anodes and the modulating grids provides a related range of differences in electron current and thus a related range of differences in luminous output from the cathodoluminescent target elements respectively associated with the plurality of display elements, and wherein position-corresponding grids in neighboring groups of elements are electrically bussed.

Ultor anode 120 is disposed contiguous to the cathodoluminescent target elements 124 on transparent faceplate 100. Ultor electrode 120 receives a predetermined relatively high ultor voltage; that is a voltage in the range of hundreds to tens of thousands of volts; preferably four to twenty kilovolts. Ultor electrode 120 is separated by a predetermined spacing from modulation grids 112 to define an acceleration section 115 therebetween. The spacing is so small that at the predetermined very low pressure and at the cited ultor voltage, no gas discharge plasma can possibly occur in acceleration section 115. The ultor voltage establishes a high-voltage gradient in the plasma-free acceleration section 115 which is effective to straight-line accelerate the beam or beams formed in the narrow opening in substantially collision-free paths directly into high-energy bombardment of cathodoluminescent target elements 124 disposed on the inner surface of transparent faceplate 100.

The triad of target elements 124R, 124G, 124B represents one set of such elements in a color display. In a panel comprising 500 rows and 500 columns of such elements, each of which comprises three discrete colors, there would be a total of 750,000 target elements. In a simple monochrome image display capable of intermediate gray tones, modulation grids 112 would be one continuous row-wise and column-wise extending grid. For a simpler monochrome display of limited intermediate gray tones (as previously described), modulation grids 112 would not be used in the panel and the sole grid means would comprise the electron transmissive scanning anodes 106, one for each column, for providing a monochrome image display relatively devoid of intermediate gray tones. (The row-select electrodes would of course be utilized in a monochrome display). Similarly, the triads of target elements 124R, 124B, and 124G respectively associated with red, blue, and green picture information would instead each comprise a monochrome light-emitting phosphor disposed on an inner surface of transparent faceplate 100.

Light-stopping means 121 provide for blocking from view the light produced by the plasma whereby the useful, visible light produced by the panel is solely that produced by the high-energy electron bombardment of the target elements 124.

Spacer 110 is shown as being spaced from faceplate 100 by a plurality of panel support members 114. There may be one panel support member 114 disposed between each of the columns, or, the support members may be more dispersed, with many columns between each support member. These support members may be row-wise extending, or, a combination of row- and column-wise extending members. These support members, together with the top and bottom plates exemplified by 128 and 130 of the row-wise extending hollow cathodes and the insulators 103 against which they abut, provide the back-to-front internal bridging support which makes the display panel self-supporting against atmospheric pressure. The material comprising panel support members 114 may, for example, be a high-strength ceramic. To prevent build-up of electrostatic charges, panel support members 114 may, for example, be coated with a conductive material 116 having a very high electrical resistance.

Panel support members 114 provide a spacing of 0.125 inch between spacer 110 and faceplate 100. The spacing dimension is dependent primarily upon the potential on ultor anode 120 which may be in the range of many hundreds to tens of thousands of volts, for example, and is a function of the gas pressure within display panel 92. The gas pressure-distance cited as an example in the foregoing, that is, 0.06 torr - centimeters, for nitrogen and a spacing of 0.125 inch, provides a high-voltage breakdown resistance of the interspace in the range of four to twenty kilovolts depending on gas mixture, field emission points, and low work function surfaces that may liberate electrons and initiate a gas breakdown. Of all of these factors, a low value of Pd is of primary importance. Any value of Pd selected must be such as to prevent the propagation of a gas discharge forward of the preferred discharge area as too high a pressure could result in an undesired secondary discharge bewteen ultor anode 120 and modulation grids 112. As a result, it could not be possible to maintain a high enough ultor anode voltage for adequate excitation of the cathodoluminescent target elements.

With regard to general structure, back wall 98 may comprise a material such as glass or other insulative material that can lend strength and rigidity to the panel 92. Back wall 98 serves both as a component of the outer envelope 92, and as a support member for the plurality of row-wise extending hollow cathodes 102.

The material from which the plates of hollow cathode 102 are preferably made comprises thin metal strips having a thickness of some two to five mils, or alternately, thick film or thin films disposed on insulative walls. If metal strips are used, metals having an expansion co-efficient substantially the same as that of glass should be used (assuming that the panel enclosure is made of glass); also, the metal may be hermetically sealable with glass, it must have a low work function, and be resistant to sputtering. Good results have been obtained with plates made with metal designated as Carpenter 42–6, available from Carpenter Technology, Inc., of Reading, Pa.

Light-stopping means 121 may comprise a film of aluminum evaporated on the inner surface of faceplate 100. Since such a film is metallic and hence electrically conductive, so it could also comprise the ultor anode. ;p With regard to display panel fabrication, techniques well-known to those skilled in the art may be used. For example, barrier 104 and spacer 110 and the openings therein may be fabricated by means such as photo-forming or thick-film screening. Also, other well-known techniques such as glass molding, etching, shaping and perforating may be utilized.

With regard to the composition of the grids, insulators and spacers illustrated by the several figures, scanning anodes 106 and modulating grids 112 may be comprised of an electrically conductive electron-transmissive mesh or grid fabricated from a material such as a stainless steel alloy. Barrier 104 and spacer 110 may be comprised of a dielectric material such as a ceramic with a thickness range of, for example, two to twenty mils. Barrier 104 and spacer 110 serve to define the geometry of the electron beam, separate the grids, and impart structural strength to the panel. Openings, such as those shown by 105, 105A and 107 of FIG. 6, may as well be in the form of circles, ovals, slots, or rectangles as shown, and be either horizontally or vertically oriented. The rectangular configuration of the openings as shown, is deemed to be one most suitable for the activation of target elements comprising color.

Concerning the selection of material for the panel generally, it is preferable that all materials have relatively the same coefficient of expansion. This coefficient is in turn based upon the flow temperature of the glass frit used to solder the panel sections together during the fritting cycle. All parts must expand and contract in concert to prevent cracking of glass and ceramic members, and to prevent component separation or changes in spacings. Expansion-compatible material suitable for panel construction are well known. Two widely used and representative materials that would lend themselves to construction of a display panel according to the preferred embodiment are glass of the soda-lime type, and metal sections of the aforementioned Carpenter 42–6.

With regard to the composition of the cathodoluminescent material, the following commercially available phosphors are representative of those suitable for the electron-acceleration voltage values of the preferred embodiment of this invention:

| | |
|---|---|
| RED | $Y_2O_2S:Eu^{+3}$ |
| GREEN | $La_2O_2S:Tb^{+3}$ |
| BLUE | $Sr_5Cl(PO_4):Eu^{+2}$ |

The weight of a self-supporting fifty-inch diagonal measure image display panel according to this invention has been determined to be between fifty and fifty-five pounds, a weight which compares most favorably with a fifty pound weight of the conventional non-self-supporting twenty-five inch color television picture tube which, it will be noted, has only one-quarter the image display area.

Here follows a description of a scanning method according to this invention for scanning the image display panel heretofore described, and illustrated by FIG. 6. As noted, the display panel shown by FIG. 6 comprises an ordered row-and-column array of individually controllable plasma-sac-type gas-discharge display elements. The panel includes an envelope containing an ionizable gas at a predetermined very low pressure. The envelope includes a transparent faceplate on an inner surface of which are disposed cathodoluminescent target elements associated with the display elements.

A method for scanning a row of the array of display elements comprises applying an activating voltage to a row-select electrode associated with a selected row to initiate a starter plasma sac in the row. Simultaneously, an activating voltage is applied to scanning anodes of a group of consecutively arranged display elements adjacent to the aforesaid row-select electrode to effect the formation by consecutive self-priming of one or more plasma sacs in the group of display elements, and thereafter, activating in sequence and group-by-group consecutive groups of display elements by row-by-row activation of associated scanning anode means and modulating grids until the entire row of display elements is scanned. Non-neighboring, regularly recurring like-numbered groups of display elements are electrically bussed such that scanning is accomplished in a bussed-scanning mode. During the activation of any given group of display elements, electrically bussed position-corresponding modulating grids respectively associated one-for-one with the display elements provide for simultaneously modulating the light output of the display elements by the application of display information stored in a multiple-element memory. The aforedescribed bussed-scanning and modulating is repeated for selected rows until the entire panel has been scanned. The activating of the display elements in element groups and the bussed-scanning and modulating of the panel in element groups in the horizontal direction, and by individual rows in the vertical direction, enhances the brightness of the panel at modest memory circuit requirements, and scanning circuitry and panel lead-ins are minimized.

Scanning of the panel is initiated by establishing a discharge between a hollow cathode 102 and a performance enhancement electrode 109 (referring again to FIG. 6). Performance enhancement electrode 109 serves to prime the gas so that the plasma sac can be scanned with low voltages. Scanning voltages may be less than 150 volts when the cathode is pulsed at minus 300 volts, for example. The row to be scanned (starting usually at the top of the panel) is established by an activating voltage having a potential of several hundred volts, for example, applied to row-select electrode 108(1) of row 1. As a result, a plasma sac forms in the associated starter opening 107. As has been noted, two basic conditions are required for plasma sac formation. The first condition is that a gas discharge must be established between a cathode and a positively charged anode by exceeding the plasma sac threshold voltage-current, the anode being in this example row-select electrode 108(1). The second condition is that an opening, or constriction, must exist between the cathode and the anode. The providing of constrictions is a function of barrier 104, which provides a discrete constriction 105 for each display element, or group of elements, as shown by FIG. 6.

Display elements can be activated group-by-group according to this invention by the ability to activate more than one display element at a time by being able to turn on more than one plasma sac at a time. To clearly distinguish the invention set forth in this disclosure, it is needful to define "group-by-group scanning" in comparison to point-at-a-time scanning and line-at-a-time scanning.

Point-at-a-time scanning of the plasma sac by bussing the anodes of the display elements has been described in the foregoing with regard to the journal article by Hori et al (Op. cit.). As the name connotes, and similarly to point-at-a-time scanning of the color cathode ray picture tube, each picture element in a display may be separately and sequentially activated for a period of 125 nanoseconds. In line-at-a-time scanning, on the other hand (also as heretofore described) incoming display information is stored in sample-and-hold circuits, one for each column of display. This information is transferred to the column drivers to activate an entire line of display elements at one time.

According to this invention, scanning of the display is accomplished group-by-group. In the context of this disclosure, and according to this invention, a "group" (also termed "display group") comprises at least two of the aforedescribed discrete display elements associated with plasma sacs which are simultaneously activated, and electrically bussed to corresponding elements in non-neighboring, regularly recurring, like-numbered other groups of display elements similarly constituted, and activated in sequence by consecutive groups.

Scanning group-by-group according to this invention provides in its preferred execution several marked advantages as follows:

1. The duty factor, and hence the brightness, is increased.

2. The rise and fall times of scanning pulses and video information can be of longer duration, thus reducing reactive power dissipation (reduced displacement current).

3. Circuit complexity and cost is reduced: The circuits for sampling and holding and video drivers can be conveniently combined on only one integrated circuit substrate for each color. This combining greatly improves display uniformity, and reduces cost in comparison to the cost of the many discrete, separately processed, integrated circuit substrates otherwise required for a full line-at-a-time scanning.

4. A small fraction of a line can be sampled, held, and read into the display, and then repeated many times during a television line time until a full television line is displayed. As a result, only one integrated circuit per color is required for the entire television display to enhance display and circuit uniformity. The benefits are readily apparent when compared to the inherent non-uniformity when many integrated circuit substrates required to sample, hold and display a full television line.

Figure 8:
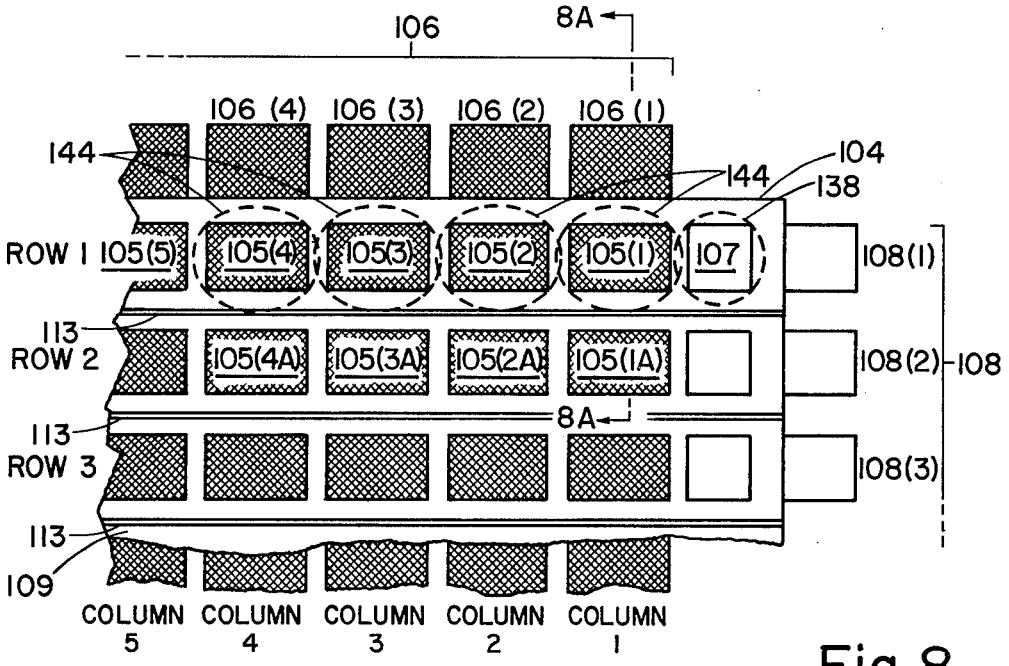
FIG. 8 is a schematic illustration of the several grids comprising an embodiment of this invention taken along lines 8—8 of FIG. 6, showing the initiation and rowwise propagation of plasma sacs by group.

The initiation and formation of a group of display elements at the beginning of a row (row 1 for example) is described in the following. FIG. 8 shows the various plasma-sac forming and scanning components from the viewpoint of the cathode, while FIG. 8A shows a view in section of FIG. 8.

Figure 8A:
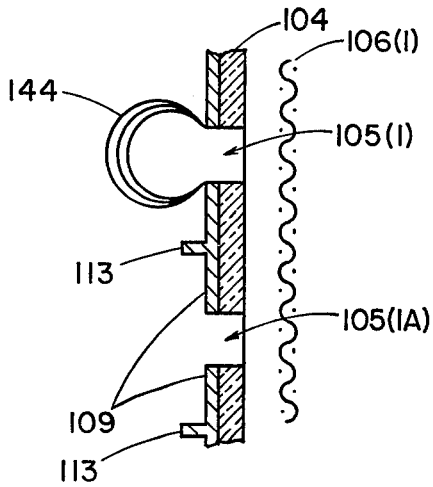
FIG. 8A is a side view in cross section of the configuration shown by FIG. 8 taken along lines 8A—8A of FIG. 8.

With regard to FIGS. 8 and 8A, barrier 104 is shown as having a plurality of openings 105 as heretofore described. In FIG. 8, openings 105 of row 1 are numbered columnwise as 105(1), 105(2) etc. A series of row-select electrodes 108, numbered columnwise downwardly 108(1), 108(2) etc., comprise a single column and thus do not extend across the width of the panel, also as heretofore described.

Plasma sac formation by groups will now be described with reference to row 1 of FIG. 8. An activation voltage nominally 150 volts, is applied to row-select electrode 108(1) associated with a selected row (row 1) to initiate a "starter" plasma sac 138 in starter opening 107. The presence of the starter sac serves to prime the four adjacent openings 105(1)–105(4). The starter voltage pulse is then removed causing the collapse of starter plasma sac 138. An electrically bussed voltage pulse is simultaneously applied to a group of four scanning anodes 106(1)–106(4) to effect the formation by consecutive self-priming of plasma sacs 144, which appear around openings 105(1)–105(4) on the cathode side of barrier 104. The plasma sacs 144 so activated comprise a group of four plasma sacs turned on simultaneously.

For exemplary purposes in this discussion, the "group" of display elements and associated plasma sacs are four in number — one element per plasma sac. It is noted that the number of elements and/or sacs per group and the number of elements per sac is not so restricted. A group of element may comprise any practical plural number of display elements; the number of associated plasma sacs may be equal to or less than the number of display elements. Plasma sacs 144, by their nature, generate and gather electrons from the associated hollow cathode means (not shown), and accelerate the electrons into the associated openings or "constrictions," 105(1)–105(4) to form four concentrated electron beams therein for activation of the aforedescribed target elements 124.

Despite the fact that scanning anodes 106(1)–106(4) extend column-wise, the plasma sacs will transfer only from starter opening 107 to openings 105(1), 105(2) etc., and remain in the row in which they were initiated; that is, row 1, because the transfer distance between the adjacent opening in row 1 is shorter than the "diagonal" distance between adjacent rows. Thus, plasma sac 104 will not move to opening 105(1A), but rather to the nearest adjacent opening 105(1). This property of the plasma sac which causes it to move only to the nearest activated opening is due to the "priming" phenomenon heretofore explained. To ensure row-wise-only sac propagation, row-wise extending barriers in the form of ridges 113 may be used.

The capability of propagating adjacent plasma sacs simultaneously in adjacent openings is attributable to the nature of priming the plasma sac and to the structure of the invention disclosed in the referent copending application Ser. No. 769,127 as described heretofore. The nature of the plasma sac permits it to gather electrons generated by the associated hollow cathode. Copious electrons supplied by the cathode in turn permit the plasma sac to draw electrons from a large surrounding area encompassing several rows and columns of display elements.

The scanning method according to this invention, which comprises scanning plasma-sac-type gas discharge display elements group-by-group, is made possible by the unique performance characteristics of the plasma sac:

1. The ability of the plasma sac or sacs to be moved along a row at near-television scan rates. Little time is lost in forming or "erasing" the sac; under the most favorable conditions the sacs are formed and reformed to scan a row according to this invention;

2. The ability of the sac or group of sacs to be "bussed-scanned";

3. The property of the sac or sacs to move only to the nearest primed apertures; and, (a corollary of 3);

4. The inability of the sacs, either singly or in groups, to arise spontaneously without being deliberately initiated, and without the adjacent presence of a strong priming source such as an adjacent sac.

The operation of the panel, and the scanning method and means according to the preferred form of the invention, can be compared to a logic AND circuit, wherein a beam of electrons cannot be emitted from any group of display elements to activate associated plasma sacs unless the following conditions prevail:

1. A gas discharge exists in the display elements comprising a group in association with a cathode supplying copious electrons to said group; AND 2. A positive potential is present on associated adjacent scanning anodes 106 in the group; AND 3. A signal-passing potential is present on associated modulating grids 112 in the group; AND 4. A plasma sac is present in associated openings.

Figure 9:
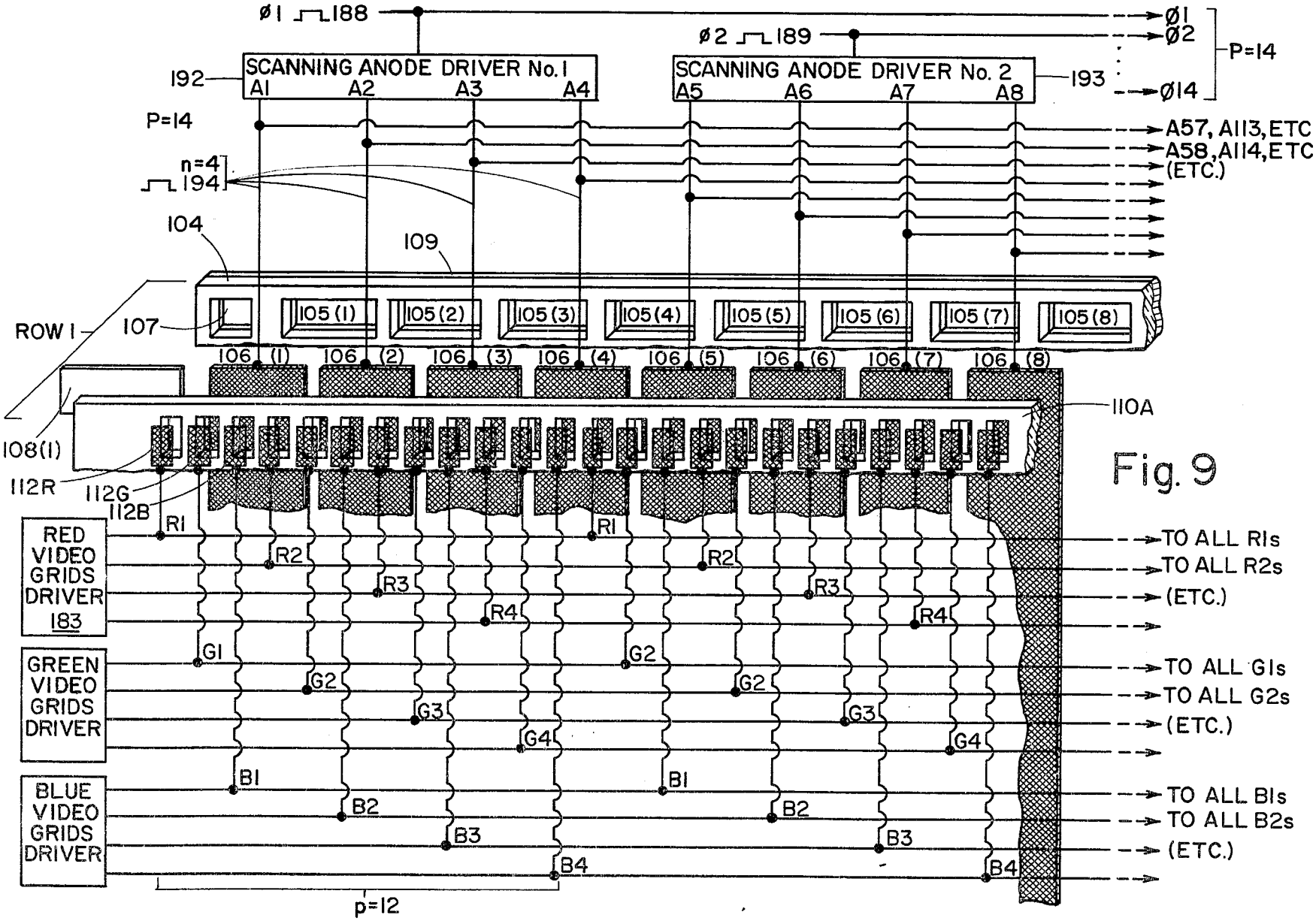
FIG. 9 shows schematically means according to this invention for scanning and modulating a single row of display elements, the illustration being taken along lines 9—9 of FIG. 6, and shown as a fragment of a row.

A method for scanning a row of display elements will now be described in detail, with reference to FIGS. 9, 9A, 9B-12. FIG. 9, illustrated from the display viewer's aspect, shows the components of row 1 of preceding FIG. 8, and additionally, the modulating components comprising spacer 110A and associated modulating grids 112. (Plasma sacs are not visible in the FIG. 9 aspect.) It will be noted that the form factor of spacer 110A differs from spacer 110 shown by FIG. 6 in that spacer 110A provides three discrete openings for the passage of each of the three beamlets 118 (referring to FIG. 6), rather than a single rectangular opening 105A. Other than this minor difference, the functions in operation of spacer 110A and spacer 110 (as heretofore described) are identical. Also included in FIG. 9 are the various interconnections and drive circuits required for row-and-column scanning according to this invention, all shown schematically.

To make the invention as illustrated by FIG. 9 and as described and claimed herein more readily understandable to those skilled in the art, a simpler scanning embodiment of the invention, represented by FIG. 9A will first be explained. In the FIG. 9A embodiment, a plasma sac is formed and scanned along a row. The sac produces a group of electron beams which are associated with a group of display elements and which activate a corresponding number of target elements. In the FIG. 9A simplified embodiment, the number of display elements in a display group is chosen to be three—one for each of red, blue and green color information.

Figure 9A:
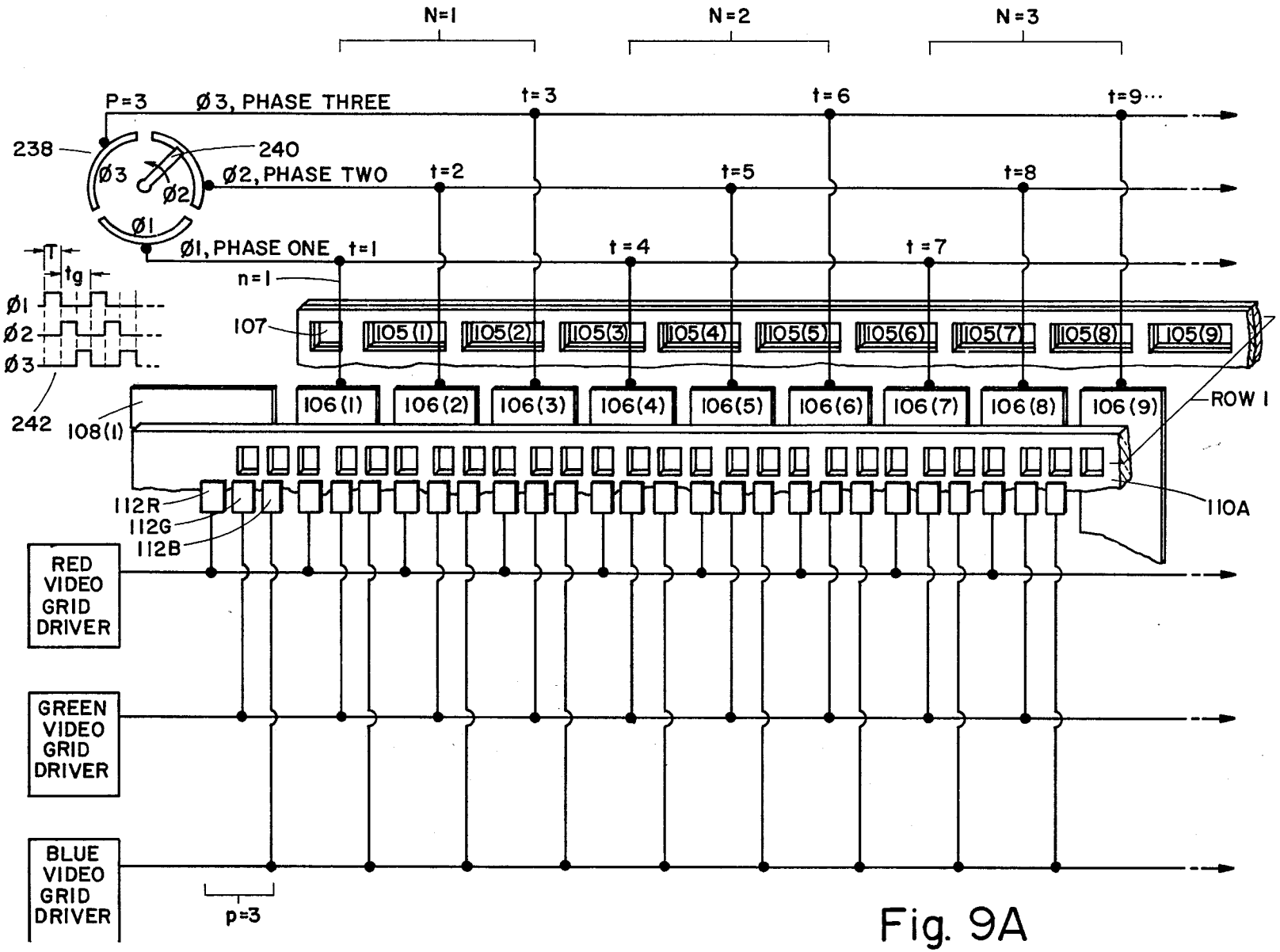
FIG. 9A is a simplified schematic view of a portion of an image display panel which illustrates in a broad context an aspect of the present invention.

It will be seen that FIG. 9A is similar to FIG. 9 except that FIG. 9A is much simplified. In this example, one "picture element" is defined as one increment of display information comprising, in a monochrome panel, a monochrome phosphor element; and in a color panel, a color triad element. Each picture element is activated by an associated electron beam passing through, and modulated by, position-corresponding electron transmissive modulating grids 112R, 112G, and 112B (refer to FIG. 6). As will be recalled, the source of electrons passing through each grid 112 is a plasma sac caused to form by (in conjunction with other conditions cited heretofore according to the invention) a positive potential applied to scanning anodes 106.

Three-phase scanning of the FIG. 9A structure is indicated schematically by a rotary switch 238 having a counterclockwise rotating center bar 240 which makes sequential connection with three sector contacts designated $\phi 1$, phase 1; $\phi 2$, phase 2 and $\phi 3$, phase 3. Phase 1 sector contact is connected to scaning anodes 106(1), 106(4), 106(7), etc. The phase 2 sector contact is connected to scanning anodes 106(2), 106(5) and 106(8), etc. Phase 3 sector contact is similarly connected to scanning anodes 106(3), 106(6) and 106(9), etc., all as shown.

The scanning cycle is initiated by a voltage pulse applied to row-select grid 108(1) to initiate a starter plasma sac in starter opening 107. The starter plasma sac "primes" adjacent opening 105(1), all as heretofore described. Center bar 240 rotates to make contact with the phase 1 sector contact, applying a voltage to scanning anode 106(1) and causing a plasma sac to form in relation to opening 105(1) which has been "primed" by the starter sac in adjacent starter opening 107. As center bar 240 continues to rotate to break contact with the phase 1 sector contact, the opening 105(1) plasma sac collapses, and a plasma sac forms in opening 105(2), primed by the adjacent plasma sac recently in opening 105(1). As center bar 240 continues to rotate, the phase 3 sector contact is energized as the phase 2 sector contact is de-energized, and the plasma sac "moves" to opening 105(3). The phase cycle is completed as center bar 240 continues its rotation to return to the phase 1 sector contact.

The timing diagram 242 indicates the sequence of voltage pulses routed to scanning anodes 106(1), 106(2) and 106(3). The duration of each pulse—phase 1, 2 or 3—is designated by T, and the de-energized period between succeeding pulses is $t_g$. The period of one complete revolution of rotating center bar 240 is $T + t_g$.

During the second cycle of rotary switch 238, as center bar 240 returns to the phase 1 sector contact, the plasma sac in opening 105(3) "moves" to opening 105(4) due to the proximity priming from opening 105(3). If the deionization time of the gas is adequate, a plasma sac will not reform in opening 105(1) because the residual ionization adjacent to opening 105(1) has decayed to a sufficiently low concentration to prevent sac formation at opening 105(1), even though its associated bussed scanning anode 106(1) is activated.

By the means described, a plasma sac will continue to scan an entire row of a display as bar 240 rotates. In practice, the rotary switch 238 comprises a circuit made up of synchronized electronic switches that produce the pulse train indicated by timing diagram 242 (as will be described).

With regard to modulation of the high-density electron beams emitted by the scanning sac, modulation grids 112R, 112G, and 112B are simultaneously activated during each phase. In similarity to the scanning anodes 106, the red, green and blue video drivers are preferably bussed, as shown by FIG. 9A. As a result, only three video grid circuits are needed for an entire television display panel. Bussing of the video grid drive circuits is made possible by the nature of the plasma sac, which acts as a "moving switch" that "turns on" only one display element at a time.

Thus, in accordance with an aspect of this invention, in the FIG. 9A simplified embodiment, display elements are activated in groups (here in triads) and each row of the display panel is buss-scanned group-by-group. It should be kept in mind that the simultaneous "ON" time of each group of display elements (here a triad) is predetermined by the width of pulses 240 (by the angular subtend of a sector contact in rotary switch 238).

Figure 9B:
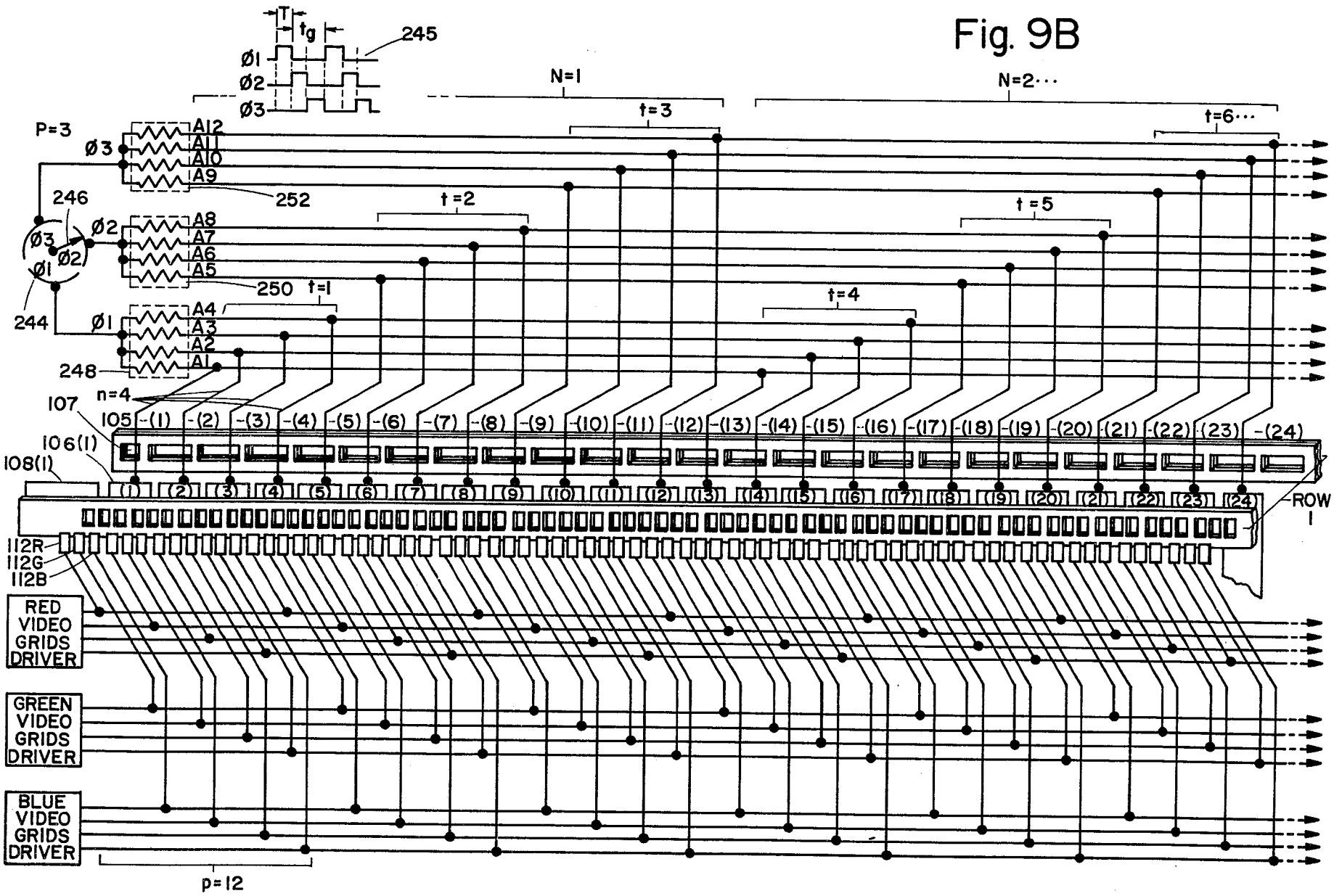
FIG. 9B is related to FIGS. 9 and 9A and shows the principle of bussed scanning by groups according to this invention, again utilizing a three-phase scanning mode which is more easily understood than the preferred embodiment which utilizes a greater number of phases.

FIG. 9B shows schematically how non-neighboring, regularly recurring like-numbered groups of display elements are electrically bussed such that scanning is accomplished by groups in a bussed-scanning mode, according to the invention. Each display group is shown as numbering four display elements; the first group, for example, comprising openings 105(1)–105(4), and four associated scanning anodes 108(1)–108(4).

Again a simple three-phase scanning system is used in FIG. 9B as an example to make more readily understandable group-by-group scanning of display elements according to the invention. As in FIG. 9A, three-phase is indicated schematically by a rotary switch 244 having a counter-clockwise rotating center bar 246. The three sector contacts designated $\phi 1$ (phase 1), $\phi 2$ (phase 2) and $\phi 3$ (phase 3) activate groups of display elements in fours as indicated by the broken-line boxes 248, 250 and 252. In this highly simplified representation, each circuit is isolated by means of a resistor. The phase 1 circuit, for example, comprises a group of scanning anodes divided into four circuits A1–A4 each having the same phase 1 pulse going to scanning anodes 106(1)–106(4). By this means, four plasma sacs (not shown) are simultaneously activated by phase 1. Likewise, using the rotary switch analogy heretofore described, phase 2 and phase 3 sequentially activate circuits A5–A8 and then A9–A12, respectively. Each of the four plasma sacs so activated by groups provide a high density electron beam which is broken into three beamlets and modulated by three grids associated therewith—grids 112R, 112G, and 112B, for example, in relation to opening 105(1). Thus in the FIG. 9B embodiment, the group of four sacs activates four color picture elements each comprised of a red-related, green-related and blue-related display element 124, for a total of twelve display elements per group.

Since four plasma sacs are activated simultaneously in this example, the associated video drive circuits must also be activated in groups of four. For example, the red video grids driver of FIG. 9B has four outputs as compared with the single red video grid driver in FIG. 9A. These four red video grids drivers of FIG. 9B simultaneously modulate the electron beams striking the first four red target elements during the first cycle of phase 1. This simultaneous modulation requires that the red video information be sampled and held in order to display more than one picture element at a time. A television receiver receives the video information serially; thus a circuit (which will be shown and described infra) is needed to sample, hold and then simultaneously activate the four video grids drivers in synchronism with the activation of the four plasma sac electron sources.

Timing diagram 245 indicates the sequence of voltage pulses routed to scanning anodes 106(1), 106(2), 106(3), etc. to activate the scanning anodes group-by-group, as shown. The duration of each pulse—phase 1, phase 2 or phase 3—is designated by T, and the de-energized period between succeeding pulses is $t_g$. The period of one complete rotation of center bar 246 is $T + T_g$.

Bussing in FIG. 9B is similar to bussing in FIG. 9A except that each phase and each color grid driver is activated in groups of four, as illustrated and according to the invention. Examination of the red video grids drivers, for example, will show that twelve display elements (corresponding to four plasma sacs, and three target elements per plasma sac) are simultaneously excited at a time as compared with only three target elements (one plasma sac) in FIG. 9A. As mentioned, the number of display elements per plasma sac and the number of sacs simultaneously activated, and thus the total number of display elements per display group (always plural) may be varied to meet the demands of each application or the invention.

To clearly define the invention according to the example cited and shown by FIG. 9B, and with reference to timing diagram 245, the relationships between the number of display groups "t" per row and the number of phases P is now examined. In FIG. 9B there are shown three phases, or $P = 3$. Each cycle of the rotary switch 244 can be thought of as defining another "phase group" of elements. A group of twelve plasma sacs are scanned for every complete phase group (corresponding to $12 \times 3 = 36$ display elements). If N be the number of such phase groups per row, it will take N rotations of the switch analog 244 to completely scan one row of the display in a time period $N(T + t_g)$.

Within each "phase group" there is another group of elements—the "display groups" mentioned heretofore. It will also be noted that all the display elements in a display group are simultaneously activated. As before, let t be the number of such display groups in one row of the display.

In FIG. 9B, there are three display groups for every phase group. It follows then that the number of display groups per row t is equal to the number of phase groups N times the number of phases P, or $t = NP$.

To define the range of t, C must be first defined as the number of picture element (color triads) in a row of the display (for television, this is approximately 500). An upper limit of t is discovered as follows: The greatest number of display groups occur when there is only one television picture element per display group. This is shown by FIG. 9A. If the number of television picture elements in a row is C, then $t = C$ is the upper limit of t. (Alternatively $t = C$ when $N = 1$ and $P = C$.)

The lower limit of t is discovered as follows: A minimum of three phases is necessary to scan the plasma sac in one direction so the minimum P is when $P = 3$. Since the minimum N is $N = 1$, then the minimum t is $t = NP = (1)(3) = 3$. Therefore the range of t according to the invention is: $3 \leqq t \leqq C$.

In practice, the deionization time of the gas places an additional restriction upon the number of groups in the display and the period of the phases (equal to T) in order to prevent back priming as is well known in the art of bussed scanning. For example, $t_g$ must be equal to or greater than the deionization time $t_i$ of the gas in order to prevent back priming. Also, the number of display groups t per row is inversely related to the period T of the phases as shown by the formula $t = t_l/T$ where $t_l$ is the time that a row in a display is energized (the ON time).

For practical applications, it is advantageous to optimize some of the above parameters. For example, in applications where it is desired to obtain maximum light output, T should be relatively large. Another application may require fast scanning of the plasma sac, such as for television displays. Such displays generally require more than the minimum three phases in order that T can be made smaller for rapid scanning, a condition which occurs when the deionization time is much larger than the period T.

The illustration of the preferred embodiment of the invention shown by FIG. 9 is necessarily limited by space to a fragment of a row; however, the relationships to FIG. 9B, used to show the principles of the invention, will be clearly seen. The significant difference between the FIGS. 9, 9A and 9B is that in FIGS. 9A and 9B, only three phases are used for scanning (P = 3), while in FIG. 9, fourteen phases (P = 14) are used for scanning. Further, the rotating switch analogs 242 and 244 have been replaced by synchronized electronic switches to produce fourteen phases, as will be shown.

With regard to FIG. 9, an activating voltage is applied to row-select grid 108(1), for example, to initiate a starter plasma sac in starter opening 107. The starter sac serves to prime the four adjacent openings 105(1)–105(4). The voltage pulse is then removed from row-select grid 108(1) causing the collapse of the starter plasma sac in starter opening 107. Simultaneously, activating voltages are applied to the scanning anodes 106(1)–106(4), which are associated with a group of consecutively arranged display elements adjacent to row-select electrode 108(1). As a result, one or more plasma sacs, (indicated herein as a group of four) are formed in openings 105(1)–105(4) on the cathode side (the opposite side from the viewer's aspect) of barrier 104 by consecutive self-priming.

Non-neighboring, regularly recurring consecutive groups of display elements in row 1 are shown in FIG. 9 as being electrically bussed to accomplish scanning in a bussed-scanning mode. For example, scanning anode driver 1, reference number 192, comprises phase 1 to activate scanning anodes 106(1)–106(4) through leads A1–A4. Scanning anode driver number 2, reference number 193, activates scanning anodes 106(5)–106(8) through leads A5–A8. There are fourteen such scanning anode drivers (corresponding to fourteen phases, P = 14) to activate the first phase group (corresponding to 4 × 14 = 56 columns of scanning anodes 106). This number of drivers is necessary to allow an adequate deionization of the gas to prevent mis-scanning, as will be explained subsequently. For bussing, lead A1 of scanning anode driver 1 is electrically bussed to lead A57 (1 + (4 × 14) = 57) and succeeding leads A2, A3, A4 etc. are each electrically bussed respectively to A58 and A59 etc., as indicated. In general, every fifty-sixth electrode is bussed for bussed-anode scanning "in fours" of simultaneously generated plasma sacs. In a display of 500 columns, for example, only 56 column drivers are needed to scan all 500 columns.

It will be observed in view of the nature of the plasma sac as set forth in this description, that even though the display elements associated with lead A1 and A57 are electrically bussed, no electron beam will be emitted from opening 105(57) because a plasma sac is not present in said opening, or adjacent to said opening, when the plasma sac is initially present in opening 105(1). As the plasma sacs, in groups of four as noted for exemplary purposes, progress row-wise due to the progressive energizing of scanning anodes 106 by the progression of scanning anode drivers, a plasma sac will eventually arise adjacent to opening 105(57); that is, at aperture 105(56). Due to the action of the associated scanning anode drivers, the potential of the scanning anode 106 associated with opening 105(56) will drop to zero, while the potential of the scanning anode associated with opening 105(57) will rise to 150 volts, for example, and the plasma sac will transfer to opening 105(57) due to the effect of the lowered breakdown voltage from priming by the previous plasma sac. The other openings electrically bussed to opening 105(57), such as the original opening 105(1), cannot emit electrons because there is no adjacent plasma sac, and no plasma scan can reform in opening 105(1) because the residual ionization from the first plasma sac in opening 105(1) has decayed to a sufficiently low concentration to prevent re-ionization at opening 105(1), even though the associated bussed scanning grid 106(1) is activated.

Figure 8B:
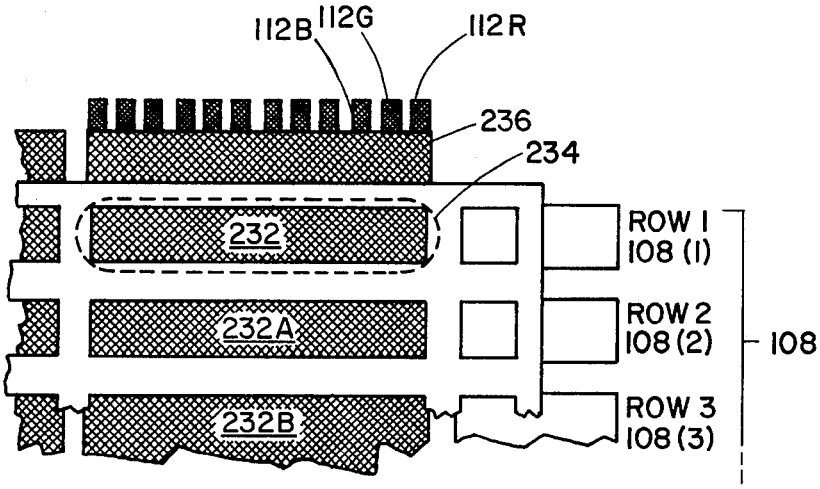
FIG. 8B is a schematic illustration identical in viewpoint to FIG. 8, but showing an elongated opening and a correlative elongated plasma sac.

Another embodiment of the invention is shown by FIG. 8B wherein the aforedescribed discrete openings 105(1)–105(4) of FIG. 8 are shown as comprising a single, horizontally elongated opening, or constriction, 232. Correspondingly, a single plasma sac 234 is similarly elongated to conform to the elongated opening 232. Anodes 106(1)–106(4), shown in FIG. 8 as being discrete, are shown as being combined into a single electron-transmissive anode 236 to cover elongated opening 232 and column-wise oriented similarly elongated openings 232A, 232B, etc. Four groups of three discrete modulation grids 112R, 112G, and 112B, unchanged in form, are illustrated in FIG. 8B to show their relationship in this embodiment of the invention with elongated opening 232 and associated plasma sac 234. The scope of the horizontal elongation of narrow openings 105 of FIG. 8 (with a related modification of associated plasma sacs, scanning anodes and modulation grids) is not restricted to the number of openings shown; the elongation according to this invention may comprise any practical number of such openings to encompass any practical opening elongation.

The operation of the ancillary electronic circuits that provide for bussed scanning and modulation of the display panel by activating in sequence and group-by-group consecutive groups of display elements row-by-row is described in the following, with reference to FIG. 9, and FIGS. 10–12. Particular reference to the timing chart, FIG. 12, will facilitate understanding of the operation.

Figure 10:
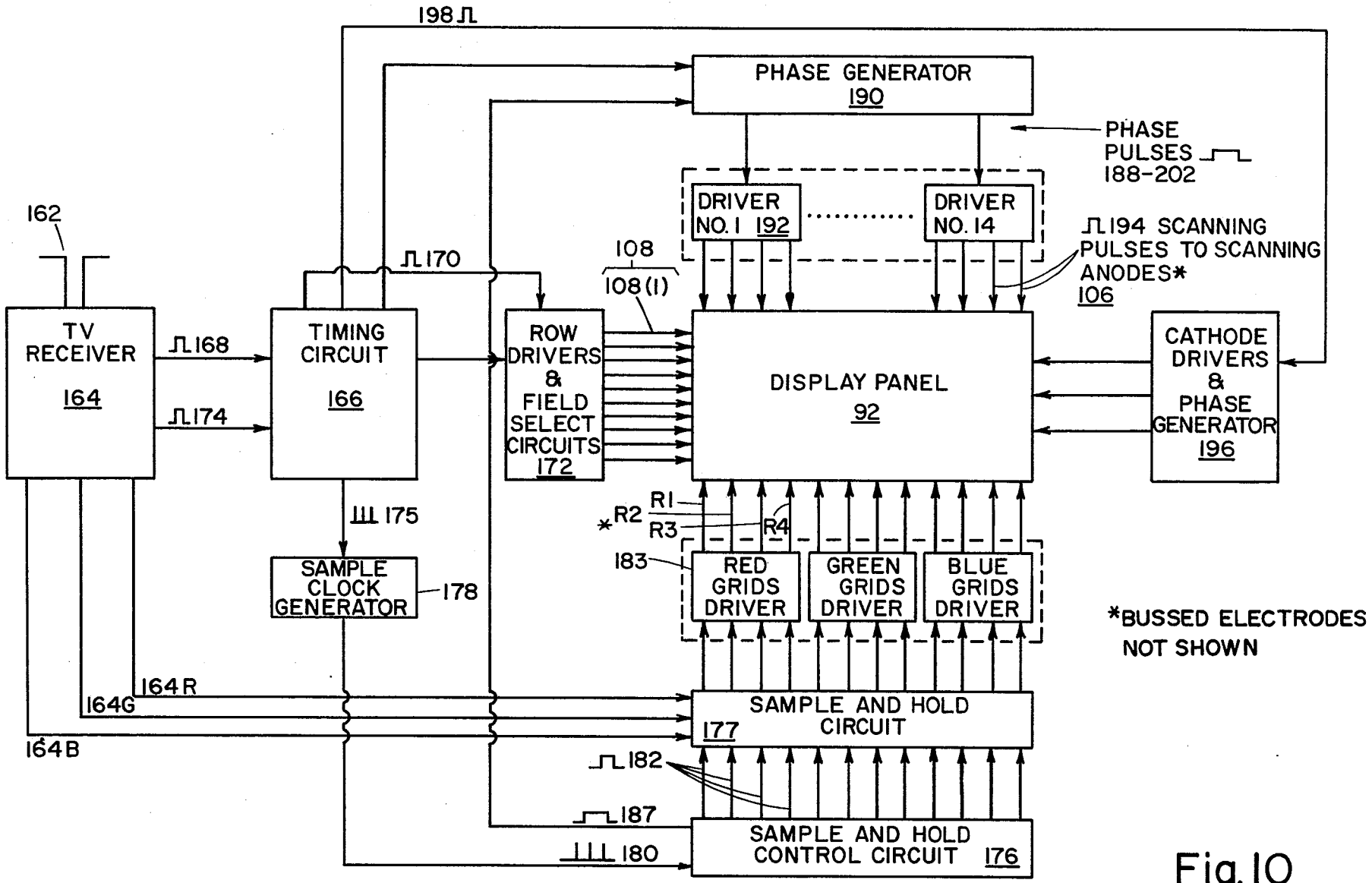
FIG. 10 is a block diagram of the ancillary circuits and stages that provide chrominance, luminance, synchronization and scanning information to the display panel of this invention.
Figure 12:
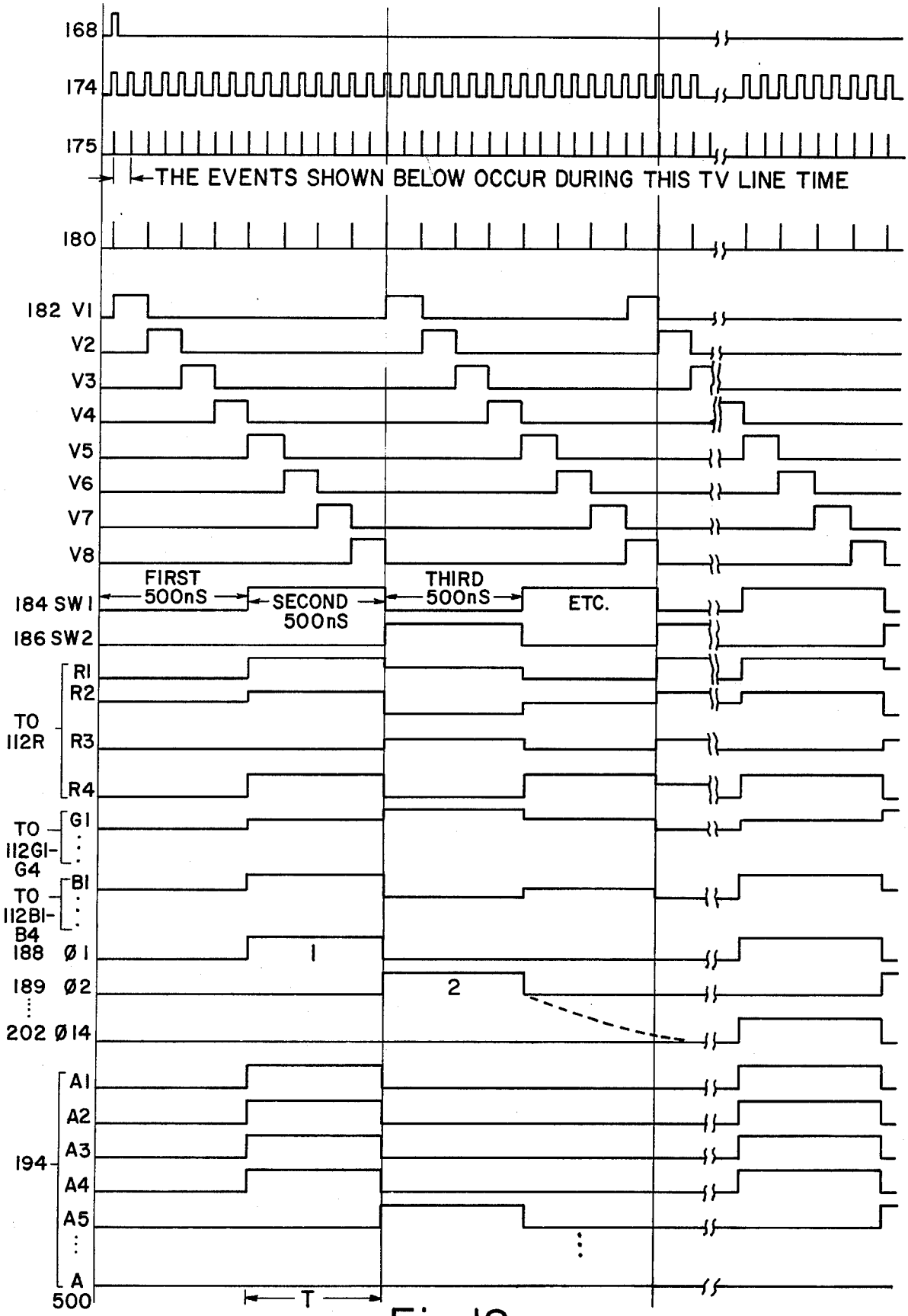
FIG. 12 is a timing diagram showing the sequence and relationship of the various synchronization and control pulses for a television picture display according to this invention.

With initial reference to FIG. 10, antenna 162 receives an over-the-air television color picture broadcast signal, for example. This signal is a composite comprising discrete chrominance, luminance and synchronization signals. The signal is accepted by the standard video processing circuit of a television receiver 164, which separates the composite signal into the discrete signals recited supra. Scanning of the first line of the top of the panel, the aforedescribed row 1, is initiated by the activating voltage of a field synchronization pulse 168 sent to timing circuit 166 at intervals of every 16.6 milliseconds. A field-select pulse 170 is sent in turn from timing circuit 166 to the row drivers and field select circuits 172. The output of stage 172 is applied to row-select grid 108(1) of grids 108, for example, to initiate a starter plasma sac and the bussed-scanning of row 1. The function of stage 172 is to periodically select the row to be scanned, whether odd or even, to provide a display picture wherein the scanning is interlaced.

A line synchronization pulse 174, occurring every sixty-three and a half microseconds, is sent to timing circuit 166 to initiate the operation of row 1 for the display of a television picture information on that row. The timing circuit 166 performs the essential function of synchronizing the video information; that is, the chrominance and luminance information, with the horizontal and vertical scanning of the display panel. According to this invention, information to be displayed, such as television video information, is sampled only for a small fraction of a television line time, such as 0.5 microseconds. This duration corresponds to four television picture elements (0.125 microseconds per element times 4 equals 0.5 microseconds).

To modulate the display elements according to this invention, the video signals comprising red, green and blue information, as indicated by 164R, 164G, and 164B, are sampled and stored in a multiple-element memory comprising sample-and-hold circuit 177 and controlled by sample-and-hold control circuit 176. As a result of the action of control circuit 176, the video information is displayed on the panel four times longer, for example, than video signals as received off-the-air. The sample-and-hold control circuit 176 is regulated in turn by a sample clock generator 178 which instructs the sample-and-hold control circuit 176 by means of a train of pulses 180 to sample the off-the-air video signals at intervals of 125 nanoseconds or less. Approximately 500 pulses 180 occur during a telvision line time. The 125 nanosecond interval corresponds to the maximum horizontal resolution capability of NTSC standards.

Figure 11:
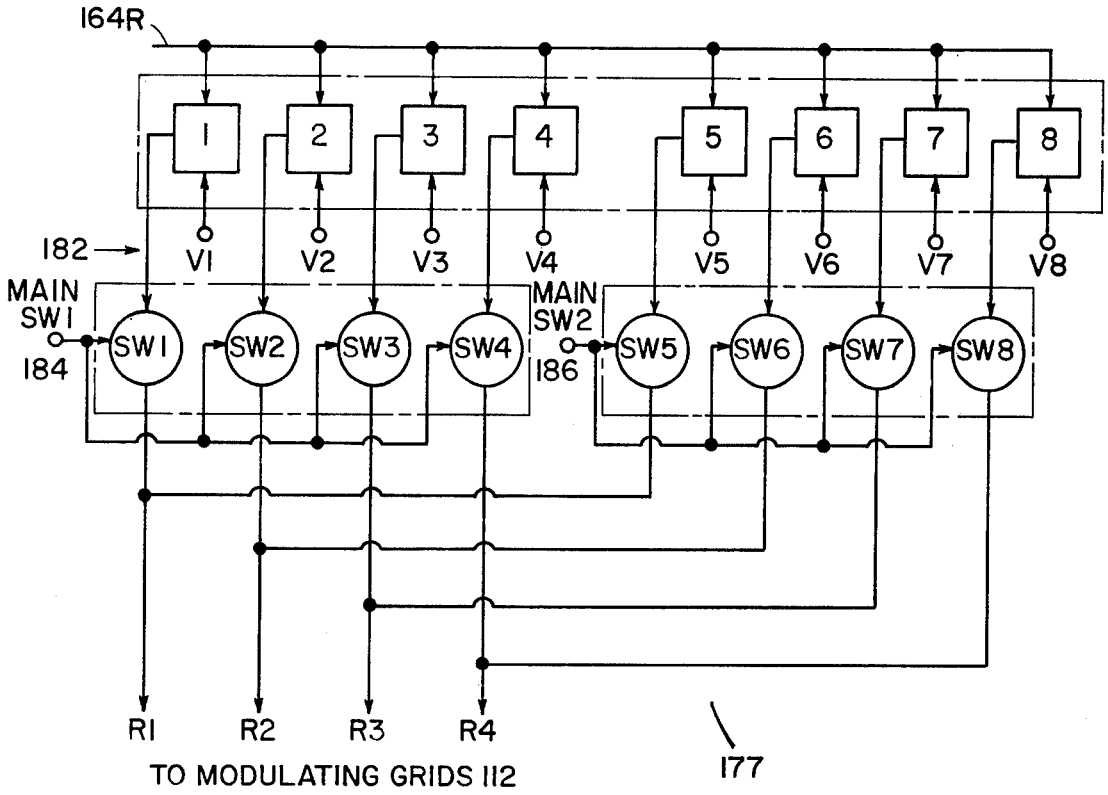
FIG. 11 is a schematic diagram of a sample-and-hold circuit for one color, in this case red, useful in this invention.

FIG. 11 represents schematically the sample-and-hold circuit 177 for storage and display of red picture information; the circuits for display of green and blue picture information are identical. Video information for red, 164R, is routed to sample-and-hold circuits 1–8, and the stored video information is read out simultaneously in groups of four to four modulation grids 112. During the first sampling time interval for sampling picture information, sample-and-hold circuits 1 through 4 are sequentially activated by sample-and-hold control pulses V1 through V4 (182) supplied by sample-and-hold control circit 176. Each control pulse V1–V4 is of 125 nanoseconds duration for a group on-time of 500 nanoseconds. When pulse V4 terminates, a pulse 184 to main switch SW1 closes switches SW1–SW4. As a result, red picture information is displayed simultaneously for 500 nanoseconds by associated display elements activated by scanning anode driver 1, 192, and red grids driver 183 which modulates grids 112R1, -R2, -R3, and -R4 with picture information. Thus, the first 500 nanosecond interval is the initial sample-and-hold interval, or "read in", while the second 500 nanosecond interval is the actual display "read-out" interval for the aforesaid modulating grids 112. During the second interval, sample-and-hold circuits 5 through 8 are similarly activated by associated sequentially activated sample-and-hold control pulses V5 through V8. Switches SW5-SW8 are activated by main switch SW2 turned on by pulse 186. By the means described, sample-and-hold circuit 177 can be used over and over to sequentially modulate an entire row of grids group-by-group, according to the invention.

As will be observed (with reference to FIG. 6) the stored video information modulates the electrons of the three electron beamlets 118 flowing through respective associated openings 105 by simultaneously modulating signals applied to the series of associated grids 112R, 112G, and 112B to modulate light output of the associated target elements, 124R, 124G, and 124B. The form of modulation may be amplitude modulation, pulse-width modulation, or a combination of both.

Only four video drivers and eight sample-and-hold circuits are required according to this invention for each color for the entire panel, no matter how large the display. This reduction in the number of required circuits and resulting simplicity is made possible by the nature of the operation of the plasma sac according to this invention. Although all the red color modulating elements of modulating grids 112 are interconnected in sets of four throughout the entire panel, as indicated by FIG. 9, no emission of electrons will take place from any one element except in the presence of the plasma sac. With reference to the conditions of the logic AND circuit cited in the foregoing, a stream of electrons cannot be emitted from any aperture to activate a target element even though a positive potential is present on any associated scanning anode 106 and modulating grid 112, unless a plasma sac is also present. Also, a plasma sac cannot be initiated unless there is an adjacent plasma sac to prime the first plasma sac. It will be recalled that the plasma sacs are said, for exemplary purposes, to sweep in groups of four from left to right across each row from the first opening 105(1) to the last, 105(500). So all scanning and all modulating grids can be activated in phases without causing emission in areas where emission is not desired, and hence all scanning anodes 106, and modulating grids 112 can be electrically bussed as shown by FIG. 9 to achieve the great reduction in the number of circuits required for driving and modulation. As a result, the brightness of the panel is enhanced at modest memory circuit requirements, and scanning circuitry and lead-ins are minimized and scanning and video modulation power is reduced. Uniformity and economy are also realized by constructing these relatively simple circuits on a single integrated circuit substrate.

The circuits for scanning by group according to the invention operate as follows. Referring again to FIGS. 9 and 10, pulses applied to the scanning anodes 106 for forming plasma sacs are initiated by a synchronizing pulse 187 developed by sample-and-hold control circuit 176. Pulse 187 is conducted to phase generator 190 which comprises a ring counter that generates 14 phases. Each "phase" drives four scanning anodes 106 simultaneously. A group of four of such drivers is called a scanning anode driver, as shown by scanning anode drivers 192 and 193. Scanning anode driver 1 is activated by pulse 188, as shown to produce scanning pulses A1–A4 (194). There are, for example, 14 such scanning anode drivers electrically bussed to associated groups of four scanning anodes 106, for a total of (14 × 4 equals) 56 drivers. Every 56th one of said scanning anodes 106 are electrically bussed, as indicated.

A period of seven microseconds (14 times 500 nanoseconds) in this example will have elapsed between successive pulses applied to scanning anodes 106(1)–106(4), etc. The plasma sacs are formed in four adjacent openings at a time and scanned to opening 105(56). In order to prevent the plasma sac from refiring back to opening 105(1), an adequate de-ionization time must be allowed so that the plasma sac will continue scanning to openings 105(57) even though the first and fifty-seventh electrodes are electrically bussed. This period of seven microseconds corresponds to the recovery time, or "deionization time," at a gas pressure of 0.2 torr in nitrogen, and the cathode-anode distance, as noted.

It is entirely possible to reduce the deionization time by selecting a gas, or a mixture of gases, having a shorter deionization time. By this means, the number of required scanning anode drivers in a display panel could be further reduced. For example, if an appropriate gas, or mixture of gases, could provide a deionization time of 3.5 microseconds, for example, only seven scanning anode drivers would be needed rather than the fourteen cited for exemplary purposes in this description.

Row-select electrodes 108 may be 500 in number to conform to the required number of rows according to NTSC standards. Also, the row-select electrodes 108 can be scanned in a manner similar to that described previously for column-wise scanning; that is, by electrically bussing them in "phases," while providing for interlaced scanning. Also as noted, it may be advantageous to scan the cathodes similarly to guarantee that proper scanning would occur without a spontaneous arising of a plasma sac at some undesired point on the display panel. For example, as shown by FIG. 6, each hollow cathode serves ten rows of picture elements 108(1)–108(10). Every tenth row of hollow cathodes can be electrically bussed and driven by phases similar to the phasedriving of scanning anode drivers 192 and 193 illustrated in FIG. 9. By this means only ten row drivers are needed to scan the display vertically. In such a display panel, the cathode drivers and phase generator circuit 196 (referring to FIG. 10) which contains a ring counter similar to that described for phase generator 190, receives a synchronization pulse 198 from timing circuit 166. Preferably, a minimum of three phases would be used for bussed-scanning the cathodes. By this scanning means, the top-most hollow cathode in the display panel would be pulsed negative (turned on first by an individual cathode driver) to generate electrons for the period during which the first ten rows at the top of the panel are active. Then the second hollow cathode immediately below the first would be turned on (as the first is turned off) while the second set of ten rows, that is, rows 11 through 20, become active, and so on from the top and bottom of the panel. For interlacing, every other row is scanned. Each hollow cathode 102, in succession would be specifically activated by a d.c. "keep-alive" potential existing on igniter wire 132 with a small trickle current, while the remaining cathodes are held in quiescence.

The method of scanning a row of the array of display elements according to the invention can also be defined in the following terms, wherein "p" is the number of display elements per display group, "n" is the number of scanning anodes 106 per display group, "m" is the number of display elements 124 per scanning anode 106 and "t" is the number of display groups in one row of the display. The method of scanning comprises applying an activating voltage to one or more scanning anodes 106 of a group of consecutively arranged display elements "p" in number to effect the formation by consecutive self-priming of one or more plasma sacs in the group of display elements wherein "n" scanning anodes 106 are respectively associated with "n" plasma sacs and with "m" display elements per scanning anode, the number "p" of display elements per group equalling m times n, but always an integer greater the unity. Thereafter, activating group-by-group "t" consecutive groups of "p" display elements in the row until the entire row of "C" (t times p) display elements is scanned, the ratio of p/C being a small fraction of one—non-neighboring, regularly recurring ones of said groups of display elements being electrically bussed such that scanning is accomplished in a bussed scanning mode.

Further with regard to the method of scanning, during the activation of any given group of display elements, modulating grids 112 respectively associated one-for-one with the display elements are simultaneously modulated to modulate the output of the display elements in the group by the application of display information stored in a "p" -element memory. Position-corresponding modulation grids in neighboring groups of elements are electrically bussed such that only "p" modulation leads are required, according to the invention.

The range in number of groups "t" per television row is according to the relationship:

$$3 \leqq t \leqq C$$

In summary, the scanning method set forth in this disclosure is highly effective for the display of television broadcasts. Benefits include enhanced display element brightness; brightness uniformity; lower system energy requirement for video modulation and plasma sac scanning; scanning at near-television rates; the requirement for fewer components and circuit amplification by combining of functions; and fewer electrical conductors entering the evacuated envelope.

A brightness-optimized cathodoluminescent plasma-sac-type gas-discharge image display panel and scanning method suitable for display of television picture images has been described and illustrated. Also, the scanning method according to the invention can be effectively utilized for the display of other types of visual information such as alphanumeric characters and vector graphics.

Other changes may be made in the above-described scanning method and apparatus without departing from the true spirit and scope of the invention herein involved. It is intended therefore that the subject matter of the foregoing depiction shall be interpreted as illustrative and not in a limiting sense.

I claim:

1. A very-low-pressure, high-voltage cathodoluminescent image display panel having an ordered row-and-column array of individually controllable plasma-sac-type gas-discharge display elements, the panel comprising:

envelope means containing an ionizable gas at a predetermined very low pressure;

plasma-sac-generating means including cathode means and anode means for forming a gas discharge plasma or plasmas, and means for constricting the plasma or plasmas to simultaneously form a plurality of electron-beam-generating plasma sacs; and scanning means coupled to said plasma-sac-generating means for scanning a row of said display elements by activating in sequence and group-by-group consecutive groups of plasma sacs in said row until the entire row of display elements is scanned.

2. A very-low-pressure, high-voltage cathodoluminescent image display panel having an ordered row-and-column array of individually controllable plasma-sac-type gas-discharge display elements, the panel comprising:

envelope means containing an ionizable gas at a predetermined very low pressure;

plasma-sac-generating means including cathode means and anode means for forming a gas-discharge plasma, and means for constricting the plasma to form one or more electron-beam-generating plasma sacs;

control means for controlling said plasma sac generating means such that at a given time, a plurality of electron beams associated with each of said sacs is generated, one beam for each display element, said control means including modulating grid means respectively associated one-for-one with said electron beams for modulating said electron beams; and scanning means coupled to said control means and to said plasma-sac-generating means for scanning a row of display elements by activating in sequence and group-by-group consecutive groups of said display elements in said row until the entire row of display elements is scanned.

3. A very-low-pressure, high-voltage cathodoluminescent image display panel having an ordered row-and-column array of individually controllable plasma-sac-type gas-discharge display elements, the panel comprising:

envelope means containing an ionizable gas at a predetermined very low pressure, said envelope means including a transparent faceplate on the inner surface of which are disposed cathodoluminescent target elements associated with said display elements;

plasma-sac-generating means including cathode means and anode means for forming a gas discharge plasma or plasmas, and means for constricting the plasma or plasmas to simultaneously form one or more electron-beam-generating plasma sacs;

control means for controlling said plasma-sac-generating means such that at a given time a plurality of electron beams associated with each of said plasma sacs are generated, said control means including modulating grid means respectively associated one-for-one with said electron beams for modulating said electron beams;

means for accelerating said electron beams into high energy impingement on respectively associated cathodoluminescent target elements; and scanning means coupled to said control means and to said plasma-sac-generating means for scanning a row of display elements by activating in sequence and group-by-group consecutive groups of said display elements in said row until the entire row of display elements is scanned.

4. A very-low-pressure, high-voltage cathodoluminescent image display panel having an ordered row-and-column array of individually controllable plasma-sac-type gas-discharge display elements, the panel comprising:

envelope means containing an ionizable gas at a predetermined very low pressure, said envelope means including a transparent faceplate on the inner surface of which are disposed cathodoluminescent target elements associated with said display elements;

plasma-sac-generating means including cathode means and anode means for forming gas-discharge plasmas, and means for constricting the plasmas to simultaneously form electron-beam-generating plasma sacs;

control means for controlling said plasma-sac-generating means such that at a given time a plurality of electron beams associated with each of said plasma sacs is emitted, said control means including modulating grid means respectively associated one-for-one with said electron beams for modulating said electron beams; and scanning means coupled to said anode means and to said modulating grid means for scanning a row of display elements by activating in sequence and group-by-group consecutive groups of said display elements in said row until the entire row of display elements is scanned.

5. A very-low-pressure, high-voltage cathodoluminescent image display panel having an ordered row-and-column array of individually controllable plasma-sac-type gas-discharge display elements, the panel comprising:

envelope means containing an ionizable gas at a predetermined very low pressure, said envelope means including a transparent faceplate on the inner surface of which are disposed cathodoluminescent target elements associated with said display elements;

plasma-sac-generating means including cathode means and anode means for forming a gas discharge plasma or plasmas, and means for constricting the plasma or plasmas to simultaneously form one or more electron-beam-generating plasma sacs;

control means for controlling said plasma-sac-generating means such that at a given time a plurality of electron beams are generated, each associated with a predetermined display element and target element;

means for accelerating said beams from said plasma sac or sacs into high-energy impingement on respectively associated cathodoluminescent target elements; and scanning means for scanning a row of said display elements by activating in sequence and group-by-group consecutive groups of display elements in said row until the entire row of display elements is scanned.

6. A very-low pressure, high-voltage cathodoluminescent image display panel having an ordered row-and-column array of individually controllable plasma-sac-type gas-discharge display elements, the panel comprising:

envelope means containing an ionizable gas at a predetermined very low pressure said envelope means including a transparent faceplate on the inner surface of which are disposed cathodoluminescent target elements associated with said display elements;

plasma-sac-generating means including cathode means and anode means for forming a gas discharge plasma or plasmas, and means for constricting said plasma or plasmas to simultaneously form one or more electron-beam-generating plasma sacs;

control means for controlling said plasma-sac-generating means such that at a given time a plurality of electron beams associated with each of said plasma sac or sacs is emitted, said control means including modulating grid means respectively associated one-for-one with said electron beams for modulating said electron beams;

means for accelerating said electron beams into high energy impingement on respectively associated cathodoluminescent target elements;

scanning means coupled to said anode means and to said modulating grid means for scanning a row of said display elements by activating in sequence in group-by-group consecutive groups of display elements in said row until the entire row of display elements is scanned.

7. A very-low-pressure, high-voltage cathodoluminescent television, alphanumeric or other image display panel having an ordered row-and-column array of individually controllable plasma-sac-type gas-discharge display elements, the panel including envelope means containing an ionizable gas at a predetermined very low pressure, said envelope means including a transparent faceplate on the inner surface of which are disposed cathodoluminescent target elements associated with said display elements, the panel comprising:

electron source means for producing at a given time a plurality of high-density electron beams associated with each of said display elements, comprising:

rearwardly disposed cathode means for receiving a relatively low applied voltage;

grid means located forwardly of said cathode means and including electron-transmissive scanning anode means spaced a predetermined distance from said cathode means for receiving a relatively intermediate applied voltage; and constriction-forming means between said scanning anode means and said cathode means defining a predetermined number of constrictions each associated with a particular scanning anode means and one or more of said display elements, with said intermediate voltage, said predetermined distance, and said very low gas pressure having values effective to support a gas discharge plasma between said cathode means and said scanning anode means, and to cause a plasma sac to form in said plasma on the cathode side of said constriction-forming means around each constriction associated with a selectively energized scanning anode means, each plasma sac by its nature generating and gathering electrons from said cathode means and accelerating them into said constriction to form a concentrated electron beam therein;

an ultor electrode disposed contiguous to said cathodoluminescent target elements on said faceplate for receiving a predetermined relatively high ultor voltage, said ultor electrode being separated by a predetermined spacing from said grid means to define an acceleration section therebetween, said spacing being so small that at said predetermined very low pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said constriction in a substantially collision-free path directly into high-energy bombardment of said cathodoluminescent target elements disposed on said faceplate; and means for scanning a row of said display elements comprising:

means for electrically bussing non-neighboring, regularly recurring like-numbered groups of display elements; and means for activating in sequence and group-by-group consecutive groups of display elements in said row until the entire row of display elements is scanned;

said scanning being accomplished in a bussed-scanning mode whereby the brightness of the panel is enhanced at modest memory circuit requirement, and scanning circuitry and panel lead-ins are minimized.

8. A very-low-pressure, high-voltage cathodoluminescent television, alphanumeric or other image display panel having an ordered row-and-column array of individually controllable plasma-sac-type gas-discharge display elements, the panel including envelope means containing an ionizable gas at a predetermined very low pressure, said envelope means including a transparent faceplate on the inner surface of which are disposed cathodoluminescent target elements associated with said display elements, the panel comprising:

electron source means for producing at a given time a plurality of high-density electron beams associated with each of said display elements, comprising:

rearwardly disposed cathode means for receiving a relatively low applied voltage;

grid means located forwardly of said cathode means and including at least an electron-transmissive scanning anode means spaced a predetermined distance from said cathode means for receiving a relatively intermediate applied voltage;

constriction-forming means between said scanning anode means and said cathode means defining a predetermined number of constrictions each associated with a particular scanning anode means and one or more of said display elements, with said intermediate voltage, said predetermined distance, and said very low gas pressure having values effective to support a gas discharge plasma between said cathode means and said scanning anode means, and to cause a plasma sac to form in said plasma on the cathode side of said constriction-forming means around each constriction associated with a selectively energized scanning anode means, each plasma sac by its nature generating and gathering electrons from said cathode means and accelerating them into said constriction to form a concentrated electron beam therein; and a modulating grid, one for each display element positioned in said electron beam formed by said plasma sac and responsive to a control signal for controlling the intensity of said beam;

an ultor electrode disposed contiguous to said cathodoluminescent target elements on said faceplate for receiving a predetermined relatively high ultor voltage, said ultor electrode being separated by a predetermined spacing from said grid means to define an acceleration section therebetween, said spacing being so small that at said predetermined very low pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said constriction in a substantially collision-free path directly into high-energy bombardment of said cathodoluminescent target elements disposed on said faceplate; and means for scanning and modulating a row of said display elements comprising:

means for electrically bussing non-neighboring, regularly recurring, like-numbered group of display elements;

means for electrically bussing position-corresponding modulating grids respectively associated one-for-one with said display elements for simultaneously modulating the light output of said display elements; and means for activating in sequence and group-by-group consecutive groups of display elements by row-by-row activation of associated scanning anode means and modulating grids until the entire row of display elements is scanned;

said scanning being accomplished in a bussed-scanning mode whereby the brightness of the panel is enhanced at modest memory circuit requirements, and scanning circuitry and panel lead-ins are minimized.

9. A very-low-pressure, high-voltage cathodoluminescent television, alphanumeric or other image display panel having an ordered row-and-column array of individually controllable plasma-sac-type gas discharge display elements, the panel including envelope means containing an ionizable gas at a predetermined very low pressure; that is, a fraction of a torr, said envelope means including a transparent faceplate on the inner surface of which is disposed cathodoluminescent target elements associated with said display elements, the panel comprising:

electron source means for producing at a given time a plurality high-density electron beams which are collectively co-extensive with and associated with a predetermined group of display elements, said electron source means comprising:

a rearwardly disposed array of large-area hollow cathodes, each scanning a predetermined plural number of rows and columns, and capable of supplying copious electrons at said predetermined very low pressure, and for receiving a relatively low voltage;

grid means located forwardly of said hollow cathode means and including electron-transmissive scanning anode means for receiving a relatively intermediate applied voltage, and associated with said scanning anode means, a coplanar row-select electrode associated with each of said rows to initiate a plasma sac in said row;

barrier means between said scanning anode means and said cathode means and defining a predetermined number of narrow openings associated with a particular scanning anode means and one or more said display elements, with said intermediate voltage, said predetermined distance, and said very low gas pressure having values effective to support a gas discharge plasma between said cathode means and said scanning anode means, and to cause a plasma sac to form in said plasma on the cathode side of said barrier means around each opening associated with a selectively energized scanning anode means, each plasma sac by its nature generating and gathering electrons from a large surrounding area of the associated hollow cathode and accelerating them into said opening to form a concentrated electron beam therein;

electron-transmissive modulating grids located downbeam of said scanning anode means and respectively associated one-for-one with said elements in said group of elements, for modulating said electron beam or beams with a like plurality of time-varying voltages to provide in cooperation with said scanning anode means full intensity control of said electron beam or beams, wherein a range of differences in potential between said scanning anode means and said modulating grids provides a related range of differences in electron current and thus a related range of differences in luminous output from the cathodoluminescent target elements respectively associated with said plurality of display elements, and wherein position-corresponding grids in neighboring groups of elements are electrically bussed;

an ultor electrode disposed contiguous to said cathodoluminescent target elements on said faceplate for receiving a predetermined relatively high ultor voltage; that is, a voltage in the range of hundreds to tens of thousands of volts, said ultor electrode being separated by a predetermined spacing from said grid means to define an acceleration section therebetween, said spacing being so small that at said predetermined very low gas pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said narrow opening in a substantially collision-free path directly into high-energy bombardment of said cathodoluminescent target elements disposed on said faceplate; and means for the bussed scanning and modulating of said array of display elements comprising:

means for applying an activating voltage on a row-select electrode associated with a selected row to initiate a starter plasma sac in said row;

means for simultaneously applying an activating voltage on said scanning anode means of a group of consecutively arranged display elements adjacent said row-select grid to effect the formation by consecutive self-priming of one or more plasma sacs in said group of display elements;

means for activating in sequence and group-by-group consecutive groups of display elements in said row until the entire row of display elements is scanned — non-neighboring, regularly recurring like-numbered groups of display elements being electrically bussed such that said scanning is accomplished in a bussed-scanning mode;

means for repeating the aforedescribed bussed-scanning and modulating for each selected row until the entire panel has been scanned, whereby said activating of said elements in element groups and the bussed-scanning and modulating of said panel of element groups in the horizontal direction and by individual rows in the vertical direction, the brightness of the panel is enhanced at modest memory circuit requirements and scanning circuitry and panel lead-ins are minimized.

10. A method for scanning a row of a very-low-pressure, high-voltage cathodoluminescent television, alphanumeric or other image display panel having an ordered row-and-column array of individually controllable plasma-sac-type gas-discharge display elements, the panel including envelope means containing an ionizable gas at a predetermined very low pressure, said envelope means including a transparent faceplate on the inner surface of which are disposed cathodoluminescent picture elements associated with said display elements, the panel comprising:

electron source means for producing at a given time a plurality of high-density electron beam associated with each of said display elements, comprising:

rearwardly disposed cathode means for receiving a relatively low applied voltage;

grid means located forwardly of said cathode means and including electron-transmissive scanning anode means spaced a predetermined distance from said cathode means for receiving a relatively intermediate applied voltage; and constriction-forming means between said scanning anode means and said cathode means defining a predetermined number of constrictions associated with a particular scanning anode means and one or more of said display elements, with said intermediate voltage, said predetermined distance, and said very low gas pressure having values effective to support a gas discharge plasma between said cathode means and said scanning anode means, and to cause a plasma sac to form in said plasma on the cathode side of said constriction-forming means around each constriction associated with a selectively energized scanning anode means, each plasma sac by its nature generating and gathering electrons from said cathode means and accelerating them into said constriction to form a concentrated electron beam therein;

an ultor electrode disposed contiguous to said cathodoluminescent target elements on said faceplate for receiving a predetermined relatively high ultor voltage, said ultor electrode being separated by a predetermined spacing from said grid means to define an acceleration section therebetween, said spacing being so small that at said predetermined very low pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said constriction in a substantially collision-free path directly into high-energy bombardment of said cathodoluminescent target elements disposed on said faceplate, said method for scanning a row of said elements comprising:

applying an activating voltage to one or more scanning anodes of a group of consecutively arranged display elements "p" in number to effect the formation by consecutive self-priming of one or more plasma sacs in said group of display elements wherein "n" scanning anodes are respectively associated with "n" plasma sacs and with "m" display elements per scanning anode, the number "p" of display elements per group equalling m × n, but always an integer greater than unity;

activating group-by-group "t" consecutive groups of "p" display elements in said row until the entire row of "C" (t × p) display elements is scanned, the ratio of p/C being a small fraction of one — non-neighboring, regularly recurring ones of said groups of display elements being electrically bussed such that said scanning is accomplished in a bussed-scanning mode; and during the activation of any given group of display elements, simultaneously modulating with modulating grids respectively associated one-for-one with said display elements in the light output of said display elements in said group by the application of display information stored in a p-element memory.

11. The method of scanning defined by claim 10 wherein the range in number of groups "t" per television row is according to the relationship:

$$3 \leqq t \leqq C$$

12. A method of scanning a row of a very-low-pressure, high-voltage cathodoluminescent television, alphanumeric or other image display panel having an ordered row-and-column array of individually controllable plasma-sac-type gas-discharge display elements, the panel including envelope means containing an ionizable gas at a predetermined very low pressure, said envelope means including a transparent faceplate on the inner surface of which are disposed cathodoluminescent picture elements associated with said display elements, the panel comprising:

electron source means for producing at a given time a plurality of high-density electron beam associated with each of said display elements, comprising:

rearwardly disposed cathode means for receiving a relatively low applied voltage;

grid means located forwardly of said cathode means and including electron-transmissive scanning anode means spaced a predetermined distance from said cathode means for receiving a relatively intermediate applied voltage; and constriction-forming means between said scanning anode means and said cathode means defining a predetermined number of constrictions each associated with a particular scanning anode means and one or more of said display elements, with said intermediate voltage, said predetermined distance, and said very low gas pressure having values effective to support a gas discharge plasma between said cathode means and said scanning anode means, and to cause a plasma sac to form in said plasma on the cathode side of said constriction-forming means around each constriction associated with a selectively energized scanning anode means, each plasma sac by its nature generating and gathering electrons from said cathode means and accelerating them into said constriction to form a concentrated electron beam therein;

an ultor electrode disposed contiguous to said cathodoluminescent target elements on said faceplate for receiving a predetermined relatively high ultor voltage, said ultor electrode being separated by a predetermined spacing from said grid means to define an acceleration section therebetween, said spacing being so small that at said predetermined very low pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said constriction in a substantially collision-free path directly into high-energy bombardment of said cathodoluminescent target elements disposed on said faceplate, said method for scanning a row of said elements comprising:

applying an activating voltage to one or more scanning anodes of a group of consecutively arranged display elements "p" in number, to effect the formation by consecutive self-priming of one or more plasma sacs in said group of display elements wherein "n" scanning anodes are respectively associated with "n" plasma sacs and with "m" display elements per anode, the number "p" of display elements per group equalling $m \times n$ but always an integer greater than unity;

activating group-by-group "t" consecutive groups of "p" display elements in said row until the entire row of "C" ($t \times p$) display elements is scanned, the ratio of p/C being a small fraction of one — non-neighboring, regularly recurring ones of said groups of display elements being electrically bussed such that said scanning is accomplished in a bussed-scanning mode; and during the activation of any given group of display elements, simultaneously modulating with modulation grids respectively associated one-for-one with said display elements the light output of said display elements in said group by the application of display information stored in a p-element memory, position-corresponding modulation grids in neighboring groups of elements being electrically bussed such that only "p" modulation leads are required.

13. The method of scanning defined by claim 12 wherein the range in number of groups "t" per television row is according to the relationship:

$$3 \leqq t \leqq C$$

14. The method of scanning according to claim 12 wherein the interval between non-neighboring, regularly recurring ones of said groups is 14, and the interval between ones of said display elements is 56.

15. For use with a very-low-pressure high-voltage cathodoluminescent television alphanumeric, or other image display panel having a row-and-column array of individually controllable plasma-sac-type gas-discharge display elements, a method for scanning a row of said array of display elements comprising activating in sequence and group-by-group consecutive groups of display elements in said row until the entire row of display elements is scanned — non-neighboring, regularly recurring like-numbered group of display elements being electrically bussed such that said scanning is accomplished in a bussed-scanning mode whereby the brightness of the panel is enhanced at modest memory circuit requirements, and scanning circuitry and panel lead-ins are minimized.

16. For use with a high-voltage cathodoluminescent image display panel having a row-and-column array of individually controllable plasma-sac-type gas-discharge display elements, a method for scanning a row of said array of display elements comprising:

activating in sequence and group-by-group consecutive groups of display elements in said row until the entire row of display elements is scanned — non-neighboring, regularly recurring like-numbered groups of display elements being electrically bussed such that said scanning is accomplished in a bussed-scanning mode; and during the activation of any given group of display elements, simultaneously modulating the light output of display elements in said group by the application of display information stored in a multiple-element memory.

17. For use with a high-voltage cathodoluminescent image display panel having a row-and-column array of individually controllable plasma-sac-type gas-dicharge display elements, a method for scanning a row of said array of display elements comprising:

applying an activating voltage to one or more scanning anodes of a group of consecutively arranged display elements "p" in number to effect the formation by consecutive self-priming of one or more plasma sacs in said group of display elements wherein "n" scanning anodes are respectively associated with "n" plasma sacs and with "m" display elements per scanning anode, the number "p" of display elements per group equalling $m \times n$, but always an integer greater than unity;

activating group-by-group "t" consecutive groups of "p" display elements in said row until the entire row of "C" ($t \times p$) display elements is scanned, the ratio of p/C being a small fraction of one — non-neighboring, regularly recurring ones of said groups of display elements being electrically bussed such that said scanning is accomplished in a bussed-scanning mode; and during the activation of any given group of display elements, simultaneously modulating with modulating grids respectively associated one-for-one with said display elements the light output of said display elements in said group by the application of display information stored in a p-element memory.

18. The method of scanning defined by claim 17 wherein the range in number of groups "t" per television row is according to the relationship:

$$3 \leqq t \leqq C$$

19. For use with a high-voltage cathodoluminescent image display panel having a row-and-column array of individually controllable plasma-sac-type gas-discharge display elements, a method for scanning a row of said array of display elements comprising:

applying an activating voltage on one or more scanning anodes of a group of consecutively arranged display elements "p" in number, to effect the formation by consecutive self-priming of one or more plasma sacs in said group of display elements wherein "n" scanning anodes are respectively associated with "n" plasma sac and with "m" display elements per anode, the number "p" of display elements per group equalling $m \times n$ but always an integer greater than unity;

activating group-by-group "t" consecutive groups of "p" display elements in said row until the entire row of "C" ($t \times p$) display elements is scanned, the ratio of p/C being a small fraction of one — non-neighboring, regularly recurring ones of said groups of display elements being electrically bussed such that said scanning is accomplished in a bussed-scanning mode; and during the activation of any given group of display elements, simultaneously modulating with modulating grids respectively associated one-for-one with said display elements the light output of said display elements in said group by the application of display information stored in a p-element memory, position-corresponding modulation grids in neighboring groups of elements being electrically bussed such that only "p" modulation leads are required.

20. The method of scanning defined by claim 19 wherein the range in number of groups "t" per television row is according to the relationship:

$$3 \leqq t \leqq C$$

21. For use with a high-voltage cathodoluminescent gas discharge television image display panel having a row-and-column array of individually controllable plasma-sac-type gas-discharge display elements, a method for scanning a row of said array of display elements comprising activating in sequence and group-by-group consecutive groups of display elements in said row until the entire row of display elements is scanned — non-neighboring, regularly recurring like-numbered groups of display elements being electrically bussed such that said scanning is accomplished in a bussed-scanning mode whereby the brightness of the panel is enhanced at modest memory circuit requirements, and scanning circuitry and panel lead-ins are minimized, and wherein the range in number of groups "t" per television row is according to the relationship:

$$3 \leqq t \leqq C,$$

and where C is the number of display elements in a row.

* * * * *